US010591852B1

(12) United States Patent
Koyanagi et al.

(10) Patent No.: US 10,591,852 B1
(45) Date of Patent: Mar. 17, 2020

(54) FIXING DEVICE AND IMAGE FORMING APPARATUS

(71) Applicant: FUJI XEROX CO., LTD., Tokyo (JP)

(72) Inventors: Kiyoshi Koyanagi, Kanagawa (JP); Takaaki Sato, Kanagawa (JP); Kazuyoshi Itoh, Kanagawa (JP); Toru Inoue, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/253,223

(22) Filed: Jan. 22, 2019

(30) Foreign Application Priority Data

Sep. 20, 2018 (JP) ..... 2018-176442

(51) Int. Cl.
*G03G 15/20* (2006.01)

(52) U.S. Cl.
CPC ..... *G03G 15/2017* (2013.01); *G03G 15/2039* (2013.01)

(58) Field of Classification Search
CPC ..... G03G 15/2042; G03G 15/2017; G03G 15/2046
See application file for complete search history.

(56) References Cited

U.S. PATENT DOCUMENTS

2008/0131160 A1* 6/2008 Mitsuoka ..... G03G 15/5004 399/70
2015/0037052 A1* 2/2015 Muramatsu ..... G03G 15/2042 399/45
2015/0261145 A1* 9/2015 Taguchi ..... G03G 15/206 399/329

FOREIGN PATENT DOCUMENTS

JP H05289555 11/1993
JP H10232576 9/1998

* cited by examiner

*Primary Examiner* — Sevan A Aydin
(74) *Attorney, Agent, or Firm* — JCIPRNET

(57) ABSTRACT

A fixing device includes a contact portion that comes into contact with a recording material transported; a heat source that heats the contact portion and has a counter surface and an opposite surface, the counter surface facing the contact portion; a high-thermal-conductivity portion provided on the opposite surface of the heat source and extending in a width direction intersecting a transport direction of the recording material, the high-thermal-conductivity portion having a higher thermal conductivity than the contact portion; a low-thermal-conductivity portion provided between the opposite surface of the heat source and the high-thermal-conductivity portion and having a lower thermal conductivity than the high-thermal-conductivity portion; and a temperature detector that detects a temperature of the heat source and is provided on the opposite surface of the heat source and at a position shifted from the high-thermal-conductivity portion and the low-thermal-conductivity portion in the transport direction.

12 Claims, 12 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2018-176442 filed Sep. 20, 2018.

BACKGROUND

(i) Technical Field

The present disclosure relates to a fixing device and an image forming apparatus.

(ii) Related Art

There is a related-art technique applied to a fixing device that includes a heater having a heat generating body provided on a heater substrate, and a heat-resisting film slidable on the heater. In this technique, the rise of the temperature of a non-sheet-passing portion is suppressed by providing a good-thermal-conductivity member on a side of the heater opposite a side of contact with the heat-resisting film and at a downstream end in a sheet passing direction (Japanese Unexamined Patent Application Publication No. 10-232576).

There is another related-art technique applied to a fixing device that includes a heating member having a heat generating body provided on a substrate, and a film sliding on the heating member. In this technique, the rise of the temperature of a non-sheet-passing portion is suppressed by providing a high-thermal-conductivity member on a side of the heating member opposite a side of contact with the film. In this fixing device, a heat-insulating sheet is provided over an area of the high-thermal-conductivity member that faces the heat generating body, whereby the increase in the starting time taken for establishing a fixable state is suppressed (see Japanese Unexamined Patent Application Publication No. 5-289555.

SUMMARY

To suppress the excessive rise of the temperature in the non-sheet-passing area of a contact portion, such as a fixing belt, that comes into contact with the recording material, a fixing device includes, for example, a high-thermal-conductivity portion having a higher thermal conductivity than the contact portion and other relevant elements and provided on a side of a heat source that is opposite a side facing the contact portion. In such a fixing device, to suppress the conduction of heat generated by the heat source to the high-thermal-conductivity portion when, for example, the contact portion starts to be heated by the heat source, a low-thermal-conductivity portion having a lower thermal conductivity than the high-thermal-conductivity portion may be provided between the heat source and the high-thermal-conductivity portion.

In the fixing device including the low-thermal-conductivity portion and the high-thermal-conductivity portion, if a temperature detector that detects the temperature of the heat source or the like is provided on the high-thermal-conductivity portion, the heat conduction to the temperature detector through the high-thermal-conductivity portion is hindered by the low-thermal-conductivity portion.

Consequently, the responsiveness of the temperature detector with respect to a temperature change in the heat source or the like may be deteriorated.

Aspects of non-limiting embodiments of the present disclosure relate to a fixing device and so forth that includes a high-thermal-conductivity portion and a low-thermal-conductivity portion, in which the responsiveness of a temperature detector, detecting the temperature of a heat source, with respect to a temperature change in the heat source is less deteriorated than in a case where the temperature detector is provided on the high-thermal-conductivity portion.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including a contact portion that comes into contact with a recording material transported; a heat source that heats the contact portion and has a counter surface and an opposite surface, the counter surface facing the contact portion; a high-thermal-conductivity portion provided on the opposite surface of the heat source and extending in a width direction intersecting a transport direction of the recording material, the high-thermal-conductivity portion having a higher thermal conductivity than the contact portion; a low-thermal-conductivity portion provided between the opposite surface of the heat source and the high-thermal-conductivity portion and having a lower thermal conductivity than the high-thermal-conductivity portion; and a temperature detector that detects a temperature of the heat source and is provided on the opposite surface of the heat source and at a position shifted from the high-thermal-conductivity portion and the low-thermal-conductivity portion in the transport direction.

BRIEF DESCRIPTION OF THE DRAWINGS

Exemplary embodiments of the present disclosure will be described in detail based on the following figures, wherein.

DETAILED DESCRIPTION

Exemplary Embodiment 1

Figure 1:
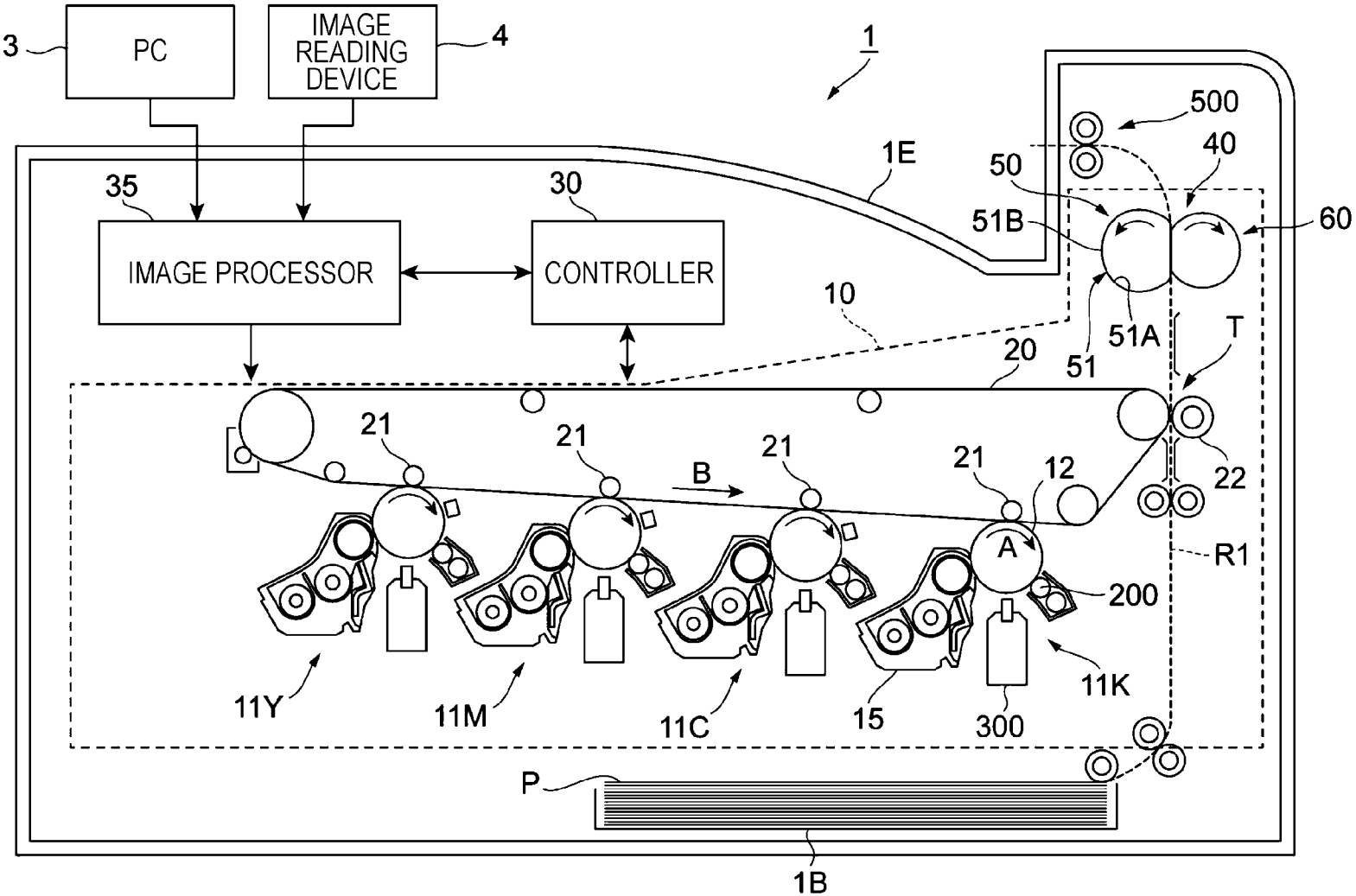
FIG. 1 illustrates an overall configuration of an image forming apparatus.

FIG. 1 illustrates an overall configuration of an image forming apparatus 1.

The image forming apparatus 1 is a so-called tandem-type color printer.

The image forming apparatus 1 includes an image forming section 10 as an exemplary image forming device. The image forming section 10 forms an image on a sheet P as an exemplary recording material in accordance with pieces of image data for different colors.

The image forming apparatus 1 further includes a controller 30 and an image processor 35.

The controller 30 controls relevant functional elements included in the image forming apparatus 1.

The image processor 35 processes the pieces of image data received from a device such as a personal computer (PC) 3 or an image reading device 4.

The image forming section 10 includes four image forming units 11Y, 11M, 11C, and 11K (hereinafter also generally denoted as "image forming units 11") arranged at intervals and in parallel.

The image forming units 11 all have the same configuration, but different kinds of toner are stored in respective developing devices 15 (to be described below). The image forming units 11 form toner images (images) in respective colors of yellow (Y), magenta (M), cyan (C), and black (K).

The image forming units 11 each include a photoconductor drum 12, a charger 200 that charges the photoconductor drum 12, and a light-emitting-diode (LED) printhead (LPH) 300 that exposes the photoconductor drum 12 to light.

The photoconductor drum 12 is charged by the charger 200. Furthermore, the photoconductor drum 12 is exposed to light emitted from the LPH 300, whereby an electrostatic latent image is formed on the photoconductor drum 12.

The image forming units 11 each further include the developing device 15 that develops the electrostatic latent image formed on the photoconductor drum 12, and a cleaner (not illustrated) that cleans the surface of the photoconductor drum 12.

The image forming section 10 includes an intermediate transfer belt 20 to which the toner images in the respective colors formed on the respective photoconductor drums 12 are transferred, and first transfer rollers 21 with which the toner images in the respective colors formed on the respective photoconductor drums 12 are transferred sequentially to the intermediate transfer belt 20 (first transfer).

The image forming section 10 further includes a second transfer roller 22 with which the toner images transferred to the intermediate transfer belt 20 are collectively transferred to the sheet P (second transfer), and a fixing device 40 that fixes the toner images to the sheet P.

The fixing device 40 includes a fixing belt module 50 and a pressing roller 60. The fixing belt module 50 includes a heat source 52.

The fixing belt module 50 is provided on the left side, in FIG. 1, of a sheet transport path R1. The pressing roller 60 is provided on the right side, in FIG. 1, of the sheet transport path R1 and is pressed against the fixing belt module 50.

The fixing belt module 50 includes a film-type fixing belt 51 that comes into contact with the sheet P.

The fixing belt 51 is an exemplary contact portion and includes, for example, a releasing layer forming an outermost layer that comes into contact with the sheet P, an elastic layer provided immediately on the inner side of the releasing layer, and a base layer supporting the elastic layer.

The fixing belt 51 has an endless shape and rotates counterclockwise in FIG. 1. An inner peripheral surface 51A of the fixing belt 51 is lubricated with a lubricant so that the sliding resistance between the fixing belt 51 and the heat source 52 and so forth to be described below is reduced. Examples of the lubricant include liquid oils such as silicone oil and fluorine oil, a mixture of a solid substance and liquid such as grease, and a combination of the foregoing materials.

The fixing belt 51 comes into contact with the sheet P that is transported from the lower side in FIG. 1, and a portion of the fixing belt 51 that has come into contact with the sheet P moves with the sheet P, whereby the sheet P is nipped between the fixing belt 51 and the pressing roller 60. Thus, the fixing belt 51 presses and heats the sheet P.

The fixing belt module 50 includes the heat source 52 (to be described below) provided on the inner side of the fixing belt 51. The heat source 52 heats the fixing belt 51.

The pressing roller 60 is an exemplary pressing portion and is provided on the right side, in FIG. 1, of the sheet transport path R1. The pressing roller 60 is pressed against an outer peripheral surface 51B of the fixing belt 51 and presses the sheet P passing through the nip between the fixing belt 51 and the pressing roller 60 (i.e., the sheet P moving along the sheet transport path R1).

The pressing roller 60 is caused to rotate clockwise in FIG. 1 by a motor (not illustrated). When the pressing roller 60 rotates clockwise, the fixing belt 51 receives a driving force from the pressing roller 60 and rotates counterclockwise.

In the image forming apparatus 1, the image processor 35 processes the pieces of image data received from the PC 3 or the image reading device 4, and the processed pieces of image data are supplied to the respective image forming units 11.

Then, in the image forming unit 11K for the black (K) color, for example, the photoconductor drum 12 is charged by the charger 200 while rotating in a direction of arrow A and is exposed to light emitted from the LPH 300 in accordance with a corresponding one of the pieces of image data received from the image processor 35.

Consequently, an electrostatic latent image based on the piece of image data for the black (K) color is formed on the photoconductor drum 12. The electrostatic latent image formed on the photoconductor drum 12 is then developed by the developing device 15, whereby a toner image in the black (K) color is formed on the photoconductor drum 12.

Likewise, other toner images in the colors of yellow (Y), magenta (M), and cyan (C) are formed in the image forming units 11Y, 11M, and 11C, respectively.

The toner images in the respective colors formed by the respective image forming units 11 are then sequentially electrostatically attracted by the respective first transfer rollers 21 to the intermediate transfer belt 20 rotating in a direction of arrow B, whereby a toner image composed of the toner images having the respective colors and superposed one on top of another is formed on the intermediate transfer belt 20.

With the rotation of the intermediate transfer belt 20, the toner image on the intermediate transfer belt 20 is transported to a position (a second transfer part T) where the second transfer roller 22 is provided. Then, in accordance with the timing of reaching of the toner image to the second transfer part T, a sheet P is supplied from a sheet container 1B to the second transfer part T.

In the second transfer part T, a transfer electric field generated by the second transfer roller 22 causes the toner image on the intermediate transfer belt 20 to be electrostatically transferred to the sheet P transported thereto.

Then, the sheet P having the toner image electrostatically transferred thereto is released from the intermediate transfer belt 20 and is transported to the fixing device 40.

In the fixing device 40, the sheet P is nipped between the fixing belt module 50 and the pressing roller 60. Specifically, the sheet P is nipped between the fixing belt 51 rotating counterclockwise and the pressing roller 60 rotating clockwise.

Thus, the sheet P is pressed and heated, whereby the toner image on the sheet P is fixed to the sheet P. The sheet P having undergone the fixing is transported to a sheet stacking portion 15 by a pair of discharge rollers 500.

Figure 2:
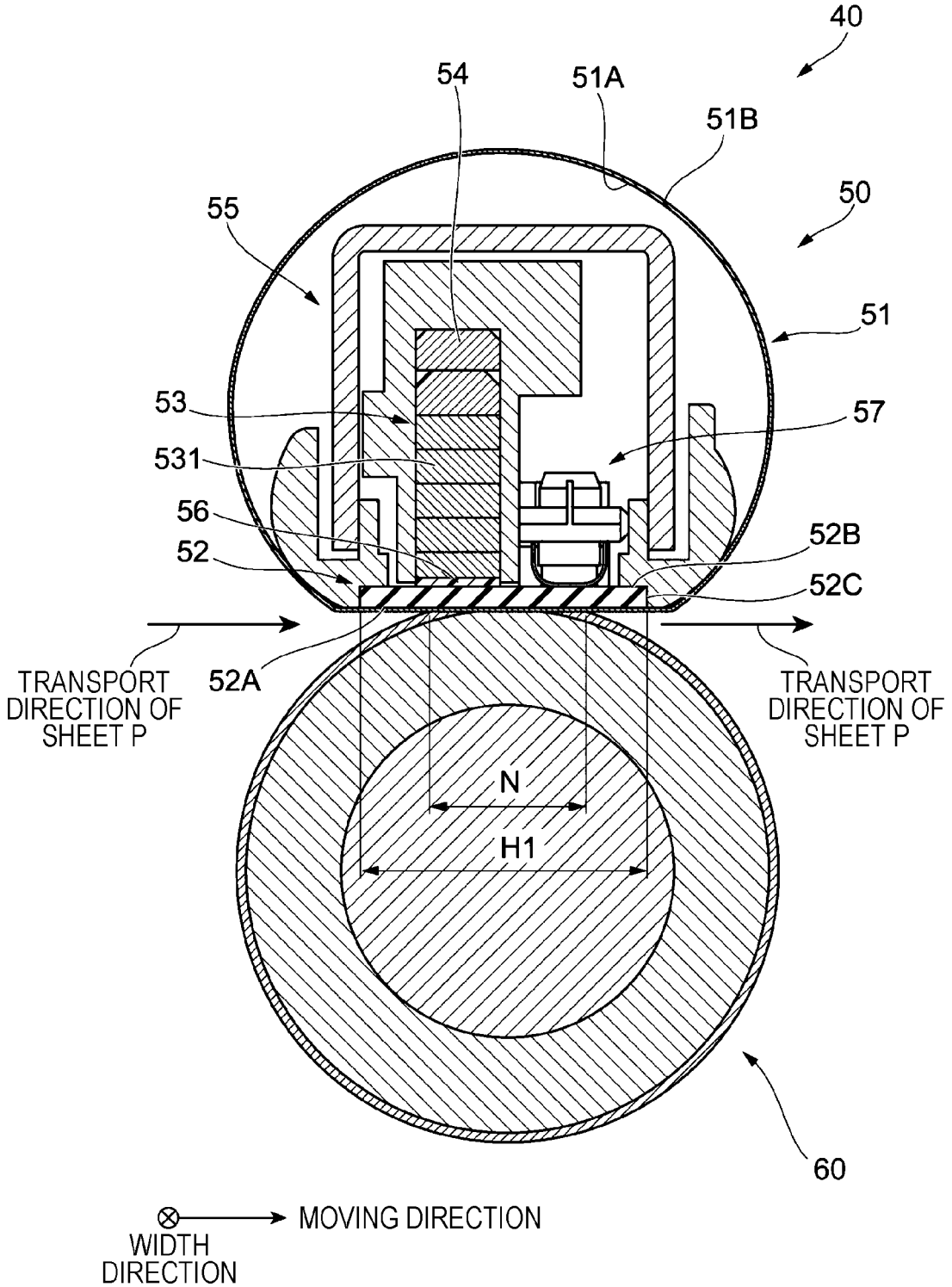
FIG. 2 illustrates a configuration of a fixing device.
Figure 3A:
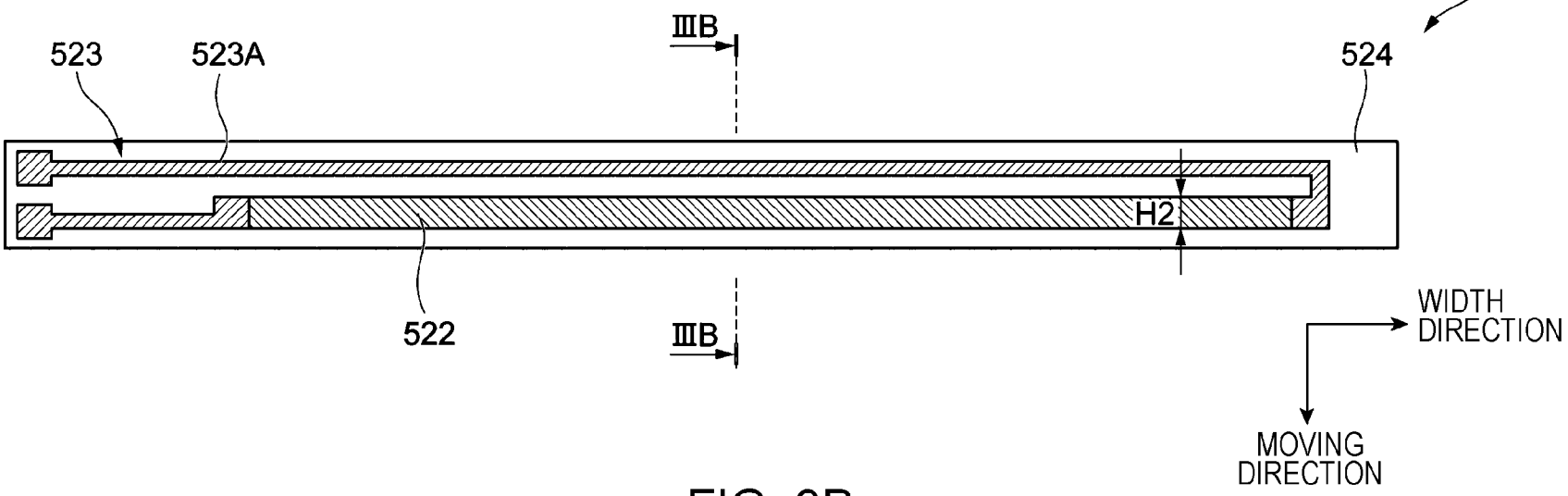
FIGS. 3A and 3B illustrate the configuration of the fixing device.
Figure 3B:
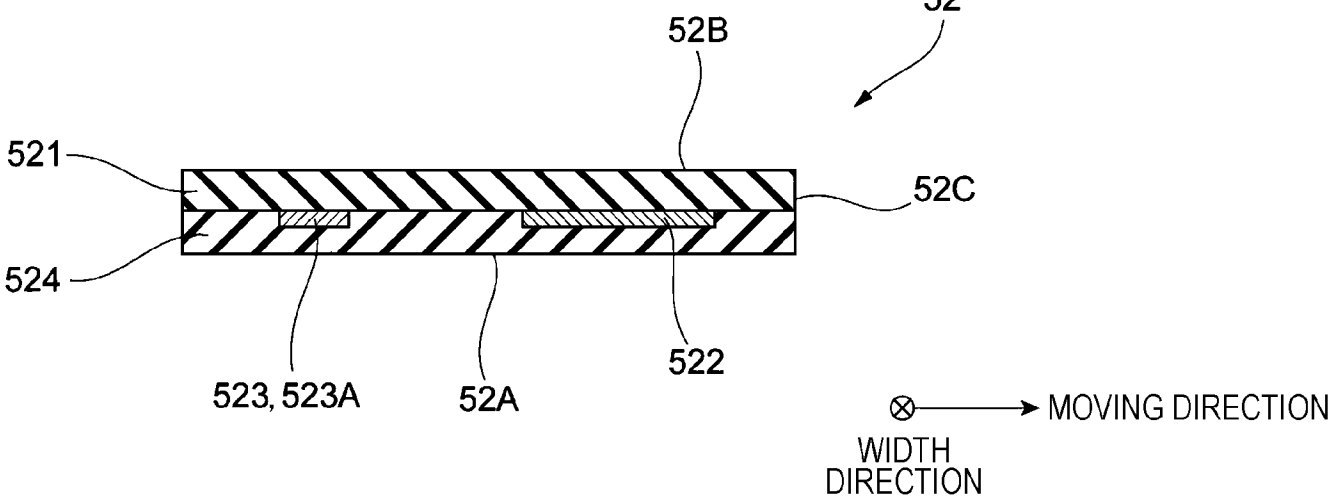

FIG. 2 and FIGS. 3A and 3B illustrate a configuration of the fixing device 40. FIG. 2 is a sectional view of the fixing device 40, more specifically, a sectional view of the fixing device 40 taken in a central portion of the fixing belt 51 in the width direction to be described below. FIGS. 3A and 3B illustrate a configuration of the heat source 52 to be described below. FIG. 3A is a plan view of the heat source 52. FIG. 3B is a sectional view of the heat source 52 taken along line IIIB-IIIB illustrated in FIG. 3A. In FIG. 3A, a base layer 521 to be described below is not illustrated.

As illustrated in FIG. 2, the fixing device 40 includes the fixing belt module 50 and the pressing roller 60.

The fixing belt module 50 includes the fixing belt 51 used for fixing the toner image to the sheet P. The fixing belt 51 is pressed against a side of the sheet P that has the toner image.

The pressing roller 60 is pressed against the outer peripheral surface 51B of the fixing belt 51 and thus presses the sheet P passing through the nip between the fixing belt 51 and the pressing roller 60.

Specifically, the pressing roller 60 is positioned in contact with the outer peripheral surface 51B of the fixing belt 51 and forms a nip part N in combination with the fixing belt 51. The nip part N formed between the pressing roller 60 and the fixing belt 51 is an exemplary pressing area through which the sheet P passes while being pressed. In the first exemplary embodiment, in the process of the passing of the sheet P through the nip part N, the sheet P is heated and pressed, whereby the toner image is fixed to the sheet P.

Hereinafter, the direction in which the fixing belt 51 moves in the nip part N is occasionally referred to as the moving direction of the fixing belt 51 or simply the moving direction. The moving direction of the fixing belt 51 in the nip part N and the transport direction of the sheet P that passes through the nip part N are the same. The width direction of the fixing belt 51 that is orthogonal to the moving direction is occasionally referred to as the width direction of the fixing belt 51 or simply the width direction.

As illustrated in FIG. 2, the fixing belt module 50 includes, on the inner side of the fixing belt 51, the heat source 52 that heats the fixing belt 51, a high-thermal-conductivity portion 53 that receives the heat from the heat source 52, and a low-thermal-conductivity portion 56 that suppresses the conduction of the heat generated by the heat source 52 to the high-thermal-conductivity portion 53. The fixing belt module 50 further includes, on the inner side of the fixing belt 51, a pressing member 54 that presses the high-thermal-conductivity portion 53 and the low-thermal-conductivity portion 56 against the heat source 52, and a support member 55 that supports the heat source 52, the high-thermal-conductivity portion 53, the low-thermal-conductivity portion 56, and the pressing member 54. The fixing belt module 50 further includes, on the inner side of the fixing belt 51, a temperature sensor 57 as an exemplary temperature detector that detects the temperature of the heat source 52.

The heat source 52 has a plate-like shape and extends in the moving direction of the fixing belt 51 and in the width direction of the fixing belt 51. The heat source 52 has a counter surface 52A that faces the fixing belt 51, and an opposite surface 52B on a side thereof opposite the counter surface 52A. The heat source 52 also has two side surfaces 52C that connect the counter surface 52A and the opposite surface 52B to each other. In the first exemplary embodiment, the counter surface 52A of the heat source 52 is in contact with the inner peripheral surface of the fixing belt 51.

In the first exemplary embodiment, heat is supplied from the heat source 52 to the fixing belt 51, whereby the fixing belt 51 is heated. Furthermore, in the first exemplary embodiment, the pressing roller 60 is pressed against the counter surface 52A of the heat source 52 with the fixing belt 51 interposed therebetween.

In the fixing device 40 according to the first exemplary embodiment, the length (denoted by reference numeral H1 in FIG. 2) of the heat source 52 in the moving direction of the fixing belt 51 is greater than the length of the nip part N in the moving direction of the fixing belt 51.

As illustrated in FIGS. 3A and 3B, the heat source 52 includes a plate-like base layer 521, and a heat generating layer 522 and power feeding layers 523 that are provided on a side of the base layer 521 nearer to the fixing belt 51 and extend in the width direction of the fixing belt 51 (see FIG. 2) that is orthogonal to the plane of FIG. 2. The heat source 52 further includes a protection layer 524 having an insulating characteristic and that covers the heat generating layer 522 and the power feeding layers 523.

The base layer 521 of the heat source 52 is formed of a substrate made of a metal material such as SUS, with an insulating layer made of glass or the like provided thereon. The base layer 521 may alternatively be made of insulating ceramic or the like, such as aluminum nitride or alumina. The base layer 521 has a uniform thickness over the entirety thereof in the width direction of the fixing belt 51. In other words, the base layer 521 has the same thickness in two end portions thereof and in a central portion thereof in the width direction of the fixing belt 51. In addition, the base layer 521 has the same heat capacity in two end portions thereof and in a central portion thereof in the width direction of the fixing belt 51.

In the description of the first exemplary embodiment, the two end portions in the width direction refers to portions positioned at two respective ends of a member of interest in the width direction and each having a predetermined length in the width direction. Likewise, the central portion in the width direction refers to a portion positioned at the center of a member of interest in the width direction and having a predetermined length in the width direction.

The heat generating layer 522 of the heat source 52 is an exemplary heat generator and is a heating resistor that generates heat by receiving electric power. The heat generating layer 522 is made of, for example, AgPd or the like. In the first exemplary embodiment, as illustrated in FIG. 3A, the heat generating layer 522 extends in the width direction of the fixing belt 51. In the first exemplary embodiment, the length of the heat generating layer 522 in the width direction is equal to the width of the widest one of the sheets that are transportable to the fixing device 40 (the maximum sheet width).

In the first exemplary embodiment, the heat generating layer 522 has a uniform thickness over the entirety thereof in the width direction of the fixing belt 51. Furthermore, the length (denoted by H2 in FIG. 3A) of the heat generating layer 522 in the moving direction of the fixing belt 51 is uniform over the entirety thereof in the width direction of the fixing belt 51. In the first exemplary embodiment, the length of the heat generating layer 522 in the moving direction of the fixing belt 51 is smaller than the length of the nip part N in the moving direction of the fixing belt 51. Furthermore, the heat generating layer 522 is positioned within an area corresponding to the nip part N (see FIG. 5A to be referred to below).

If the power supplied to the heat generating layer 522 and the thickness of the heat generating layer 522 are uniform, the amount of heat generated by the heat generating layer 522 is inversely proportional to the length of the heat generating layer 522 in a direction orthogonal to the direction of electrification of the heat generating layer 522 (in the first exemplary embodiment, the moving direction of the fixing belt 51). That is, the amount of heat generated by the heat generating layer 522 becomes greater as the length of the heat generating layer 522 in the moving direction of the fixing belt 51 becomes smaller.

The power feeding layers 523 of the heat source 52 are exemplary electrode portions and are connected to one width-direction end and to the other width-direction end of the heat generating layer 522, respectively, thereby feeding electric power to the heat generating layer 522. The power feeding layers 523 are made of metal having a lower resistance than the heat generating layer 522, for example, Ag, or AgPd or the like containing a greater ratio of Ag than the heat generating layer 522. The power feeding layers 523 generate substantially no heat even if an electric current is supplied thereto, unlike the heat generating layer 522.

In the first exemplary embodiment, as illustrated in FIG. 3A, one of the power feeding layers 523 includes an extended portion 523A provided adjacent to and on the upstream side with respect to the heat generating layer 522 in the moving direction of the fixing belt 51 and extending in the width direction of the fixing belt 51. In the first exemplary embodiment, the extended portion 523A of the power feeding layer 523 is bent at one width-direction end thereof (the right end in FIG. 3A), and the bent end is connected to one end of the heat generating layer 522.

The protection layer 524 of the heat source 52 covers and protects the heat generating layer 522 and the power feeding layers 523 provided on the base layer 521. The protection layer 524 is made of, for example, baked glass having an insulating characteristic.

The pressing member 54 (see FIG. 2) is provided between the high-thermal-conductivity portion 53 (see FIG. 2) and the support member 55 (see FIG. 2) and presses the high-thermal-conductivity portion 53 against the opposite surface 52B of the heat source 52. The pressing member 54 brings a plurality of high-thermal-conductivity members 531, to be described below, included in the high-thermal-conductivity portion 53 into close contact with one another.

The pressing member 54 is an elastic member, such as a compression spring or a rubber member, and presses the high-thermal-conductivity portion 53 and the low-thermal-conductivity portion 56 against the heat source 52 with the elastic restoring force thereof.

The high-thermal-conductivity portion 53 is provided on the low-thermal-conductivity portion 56 and in contact therewith and receives heat from the heat source 52 through the low-thermal-conductivity portion 56. In other words, the heat source 52 supplies heat to the high-thermal-conductivity portion 53 through the low-thermal-conductivity portion 56. The state where the high-thermal-conductivity portion 53 is provided on the low-thermal-conductivity portion 56 and in contact therewith includes not only a state where the high-thermal-conductivity portion 53 is provided directly on the low-thermal-conductivity portion 56 but also a state where the high-thermal-conductivity portion 53 is provided on the low-thermal-conductivity portion 56 with, for example, heat-conducting grease or the like interposed therebetween.

The high-thermal-conductivity portion 53 according to the first exemplary embodiment includes the plurality of high-thermal-conductivity members 531 each having a plate-like shape and that are stacked one on top of another with heat-conducting grease or the like interposed therebetween. The high-thermal-conductivity portion 53 formed of the stack of the high-thermal-conductivity members 531 generally has a block-like shape.

The high-thermal-conductivity members 531 forming the high-thermal-conductivity portion 53 are each made of a material having a higher thermal conductivity than at least one of the materials forming the fixing belt 51 and the base layer 521 and the protection layer 524 of the heat source 52. The high-thermal-conductivity members 531 may each be made of a material having a higher thermal conductivity than the material forming the fixing belt 51.

The material forming the high-thermal-conductivity members 531 may be, for example, metal such as copper or aluminum, or an alloy such as SUS. The high-thermal-conductivity members 531 may all be made of the same material or different materials.

In the first exemplary embodiment, the high-thermal-conductivity portion 53 includes the stack of the high-thermal-conductivity members 531 each having a plate-like shape. Therefore, when the high-thermal-conductivity portion 53 is pressed by the pressing member 54, the high-thermal-conductivity members 531 deform independently of one another. Hence, the high-thermal-conductivity portion 53 comes into contact with the low-thermal-conductivity portion 56 more closely than in a case where, for example, the high-thermal-conductivity portion 53 is formed of a single block-like member.

The high-thermal-conductivity portion 53 supplies heat generated in a portion of the heat source 52 that is at a high temperature to another portion of the heat source 52 that is at a low temperature.

If the sheet P to be subjected to the fixing process has a small width, the temperature of the heat source 52 tends to rise in non-sheet-passing areas that are at the two width-direction ends of the heat source 52 and do not come into contact with the sheet P. In such a case, temperature non-uniformity in the width direction may occur in the heat source 52 and in the fixing belt 51. If the fixing process of any sheet P having a larger width is performed after the occurrence of such temperature nonuniformity, fixing non-uniformity may occur.

In contrast, if the high-thermal-conductivity portion 53 is provided, the heat of the portion of the heat source 52 that is at a high temperature is supplied to the portion of the heat source 52 that is at a low temperature. Therefore, the temperature nonuniformity in the heat source 52 and in the fixing belt 51 is reduced.

The low-thermal-conductivity portion 56 is provided on the opposite surface 52B of the heat source 52 and in contact therewith. The state where the low-thermal-conductivity portion 56 is provided on the opposite surface 52B and in contact therewith includes not only a state where the low-thermal-conductivity portion 56 is provided directly on the opposite surface 52B of the heat source 52 but also a state where the low-thermal-conductivity portion 56 is provided on the opposite surface 52B with, for example, heat-conducting grease of the like interposed therebetween.

The low-thermal-conductivity portion 56 is made of a material having a lower thermal conductivity than the material forming the high-thermal-conductivity portion 53 (the high-thermal-conductivity members 531). The low-thermal-conductivity portion 56 is made of, for example, a heat-resisting resin material or the like, such as polyimide, and is provided in the form of a thin film.

The low-thermal-conductivity portion 56 has the same shape as the high-thermal-conductivity portion 53 when seen in the direction of stacking of the low-thermal-conductivity portion 56 and the high-thermal-conductivity portion 53 on the heat source 52 (the top-bottom direction in FIG. 2).

In the first exemplary embodiment, since the low-thermal-conductivity portion 56 is provided between the heat source 52 and the high-thermal-conductivity portion 53, the time taken for the fixing belt 51 to reach a predetermined temperature at the start of heating of the fixing belt 51 by the heat source 52 is shorter than in a case where the low-thermal-conductivity portion 56 is not provided.

That is, in the first exemplary embodiment, since the low-thermal-conductivity portion 56 having a lower thermal conductivity than the high-thermal-conductivity portion 53 is provided, the heat generated by the heat generating layer 522 of the heat source 52 is prevented from being directly conducted to the high-thermal-conductivity portion 53. Hence, the heat generated by the heat generating layer 522 of the heat source 52 is more likely to be conducted to the fixing belt 51 than in the case where the low-thermal-conductivity portion 56 is not provided. Consequently, at the start of heating of the fixing belt 51, the temperature of the fixing belt 51 tends to be raised quickly with the heat generated by the heat generating layer 522.

When the fixing belt 51 heated has reached the predetermined temperature, the temperature of the low-thermal-conductivity portion 56 rises correspondingly. When the temperature of the low-thermal-conductivity portion 56 rises, the heat is gradually conducted from the low-thermal-conductivity portion 56 to the high-thermal-conductivity portion 53.

For example, if the sheet P to be subjected to the fixing process has a small width and the temperature of the non-sheet-passing areas at the two respective width-direction ends of the heat source 52 rises, the heat is conducted from the two width-direction ends of the heat source 52 to the high-thermal-conductivity portion 53 through the low-thermal-conductivity portion 56. The heat thus conducted from the two width-direction ends of the heat source 52 to the high-thermal-conductivity portion 53 is conducted throughout the high-thermal-conductivity portion 53 in the width direction and is supplied through the low-thermal-conductivity portion 56 to the width-direction central portion of the heat source 52 that is at a low temperature. Thus, the temperature nonuniformity in the heat source 52 and in the fixing belt 51 is reduced.

The temperature sensor 57 is provided in such a manner as to face an object of temperature detection and detects the temperature of the object. Details of the temperature sensor 57 will be described separately below. In the first exemplary embodiment, the temperature sensor 57 is provided in contact with the opposite surface 52B of the heat source 52, which is the object of temperature detection, and thus detects the temperature of the heat source 52. In accordance with the temperature of the heat source 52 that is detected by the temperature sensor 57, the controller 30 (see FIG. 1) controls the supply of electric power to the heat generating layer 522 of the heat source 52 and other relevant operations.

In the first exemplary embodiment, the temperature sensor 57 is one of a plurality of temperature sensors 57 that are provided on the opposite surface 52B of the heat source 52 and are arranged at intervals in the width direction (see FIG. 4 to be referred to below).

The temperature sensor 57 is not limited to but may be, for example, a thermistor-type temperature detection sensor. Examples of the thermistor-type temperature detection sensor to be employed as the temperature sensor 57 include a negative-temperature-coefficient (NTC) thermistor whose resistance decreases with the rise of temperature, a positive-temperature-coefficient (PTC) thermistor whose resistance increases with the rise of temperature, a critical-temperature-resistor (CTR) thermistor whose resistance decreases with the rise of temperature but that has good sensitivity in a specific range of temperature, and other various types of thermistors.

Alternatively, the temperature sensor 57 may be a thermostat or the like that stops the supply of electric power to the heat source 52 in accordance with the temperature detected.

In the fixing device 40 including the high-thermal-conductivity portion 53 and the low-thermal-conductivity portion 56, if the temperature sensor 57 is provided on the high-thermal-conductivity portion 53, for example, the heat conduction from the high-thermal-conductivity portion 53 to the temperature sensor 57 is prevented by the low-thermal-conductivity portion 56. In such a case, the responsiveness of the temperature sensor 57 with respect to a temperature change in the heat source 52 may be deteriorated. In other words, if there is a sudden temperature change in the heat source 52, it may take a long time for the temperature sensor 57 to detect such a sudden temperature change in the heat source 52.

To avoid such a situation, in the fixing device 40 according to the first exemplary embodiment, the temperature sensor 57 is provided at a position shifted from the high-thermal-conductivity portion 53 and the low-thermal-conductivity portion 56 in the moving direction of the fixing belt 51, whereby the deterioration in the responsiveness of the temperature sensor 57 with respect to a temperature change in the heat source 52 is suppressed. Now, the arrangement and other relevant factors of the high-thermal-conductivity portion 53, the low-thermal-conductivity portion 56, and the temperature sensor 57 in the fixing device 40 will be described specifically.

Figure 4:
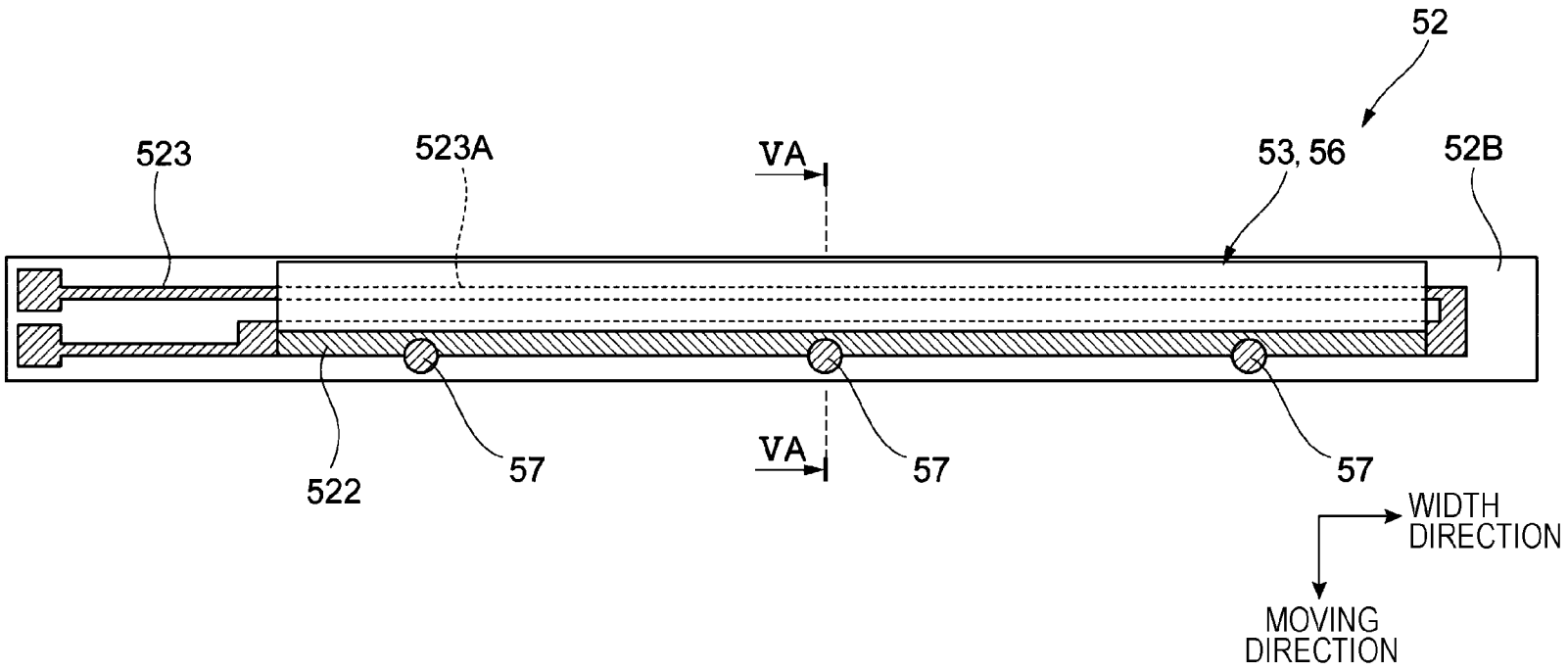
FIG. 4 illustrates an arrangement of a heat source, a high-thermal-conductivity portion, a low-thermal-conductivity portion, and temperature sensors according to a first exemplary embodiment.
Figure 5A:
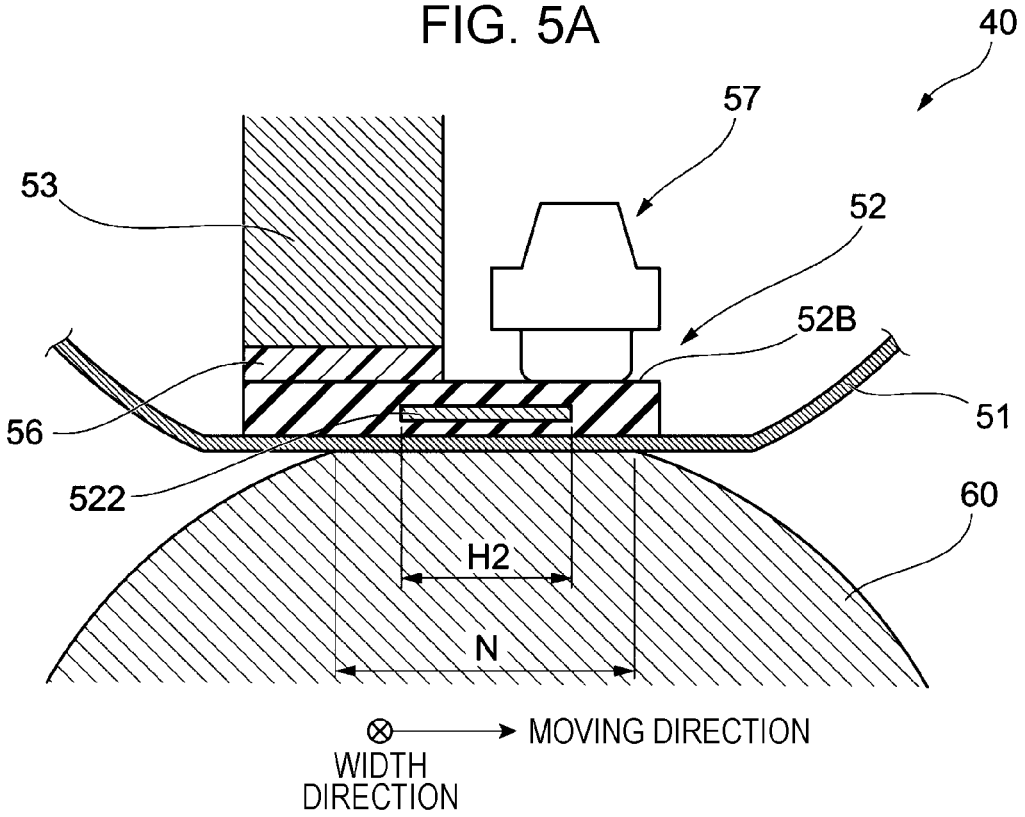
FIG. 5A illustrates the arrangement of the heat source, the high-thermal-conductivity portion, the low-thermal-conductivity portion, and the temperature sensors according to the first exemplary embodiment.
Figure 5B:
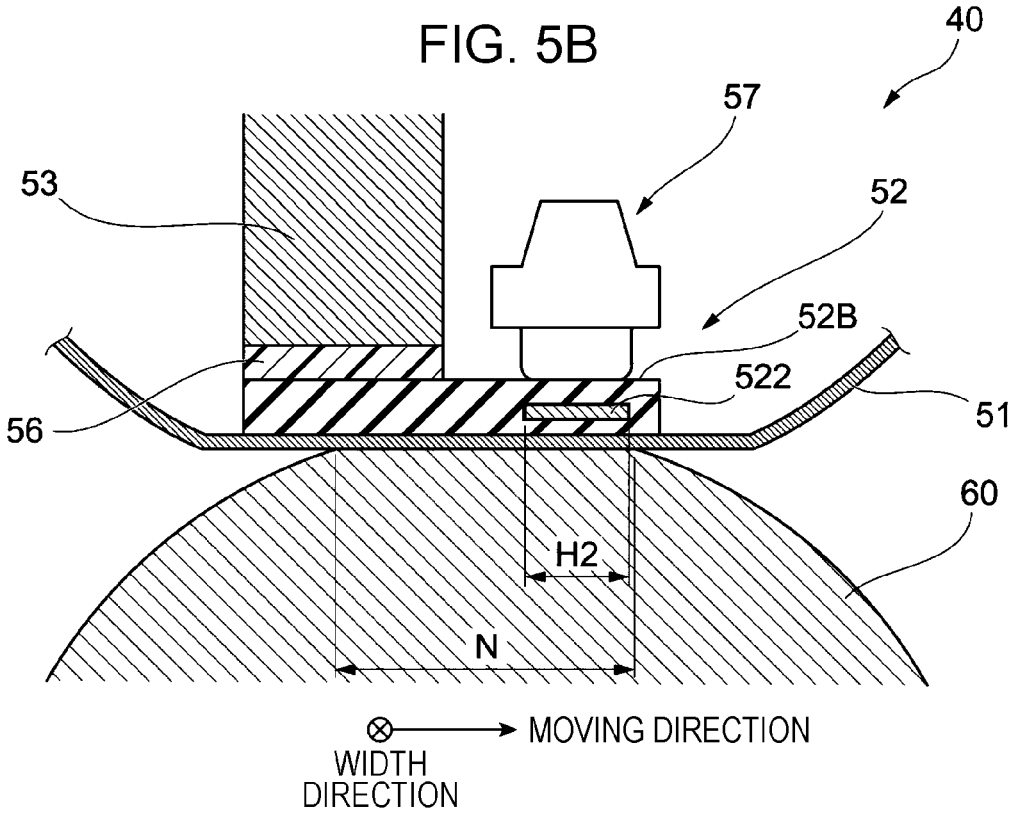
FIG. 5B illustrates another arrangement of the heat source, the high-thermal-conductivity portion, the low-thermal-conductivity portion, and the temperature sensors according to the first exemplary embodiment.

FIG. 4 and FIGS. 5A and 5B each illustrate an arrangement of the heat source 52, the high-thermal-conductivity portion 53, the low-thermal-conductivity portion 56, and the temperature sensors 57 according to the first exemplary embodiment. FIG. 4 is a plan view of the heat source 52, the high-thermal-conductivity portion 53, the low-thermal-conductivity portion 56, and the temperature sensors 57 seen in the direction of stacking of the high-thermal-conductivity portion 53 and so forth on the heat source 52. FIG. 5A is a sectional view of a width-direction central portion of the fixing device 40, taken along line VA-VA illustrated in FIG. 4. FIG. 5B illustrates a modification of the fixing device 40 illustrated in FIG. 5A.

In FIG. 4, the base layer 521 of the heat source 52 is not illustrated. Furthermore, the high-thermal-conductivity portion 53 and the low-thermal-conductivity portion 56 according to the first exemplary embodiment have the same shape when seen in the direction of stacking of thereof on the heat source 52, as described above. Therefore, in FIG. 4, the low-thermal-conductivity portion 56 is behind the high-thermal-conductivity portion 53 and is not illustrated. In FIGS. 5A and 5B, the power feeding layers 523 (see FIG. 4) of the heat source 52 are not illustrated, and the plurality of high-thermal-conductivity members 531 (see FIG. 2) are collectively illustrated as the high-thermal-conductivity portion 53. Hereinafter, the plurality of high-thermal-conductivity members 531 will be collectively described as the high-thermal-conductivity portion 53, occasionally.

The high-thermal-conductivity portion 53 according to the first exemplary embodiment generally has a long shape in the width direction. As illustrated in FIG. 4, in the width direction, the high-thermal-conductivity portion 53 has the same length as the heat generating layer 522 of the heat source 52. In the moving direction, the high-thermal-conductivity portion 53 has a uniform length over the entirety thereof from one width-direction end to the other width-direction end. In the moving direction, the high-thermal-conductivity portion 53 has a length smaller than the length (denoted by H1 in FIG. 2) of the heat source 52.

As with the high-thermal-conductivity portion 53, the low-thermal-conductivity portion 56 according to the first exemplary embodiment has a long shape in the width direction. In the width direction, the low-thermal-conductivity portion 56 has the same length as the heat generating layer 522 of the heat source 52. In the moving direction, the low-thermal-conductivity portion 56 has a uniform length over the entirety thereof from one width-direction end to the other width-direction end. In the moving direction, the low-thermal-conductivity portion 56 has a length smaller than the length (denoted by H1 in FIG. 2) of the heat source 52.

As illustrated in FIG. 5A, the high-thermal-conductivity portion 53 and the low-thermal-conductivity portion 56 are provided on the opposite surface 52B of the heat source 52 and on an upstream portion of the heat source 52 in the moving direction. That is, the opposite surface 52B of the heat source 52 includes a portion on the downstream side thereof where the high-thermal-conductivity portion 53 and the low-thermal-conductivity portion 56 are not present.

In the first exemplary embodiment, as illustrated in FIG. 5A, the high-thermal-conductivity portion 53 and the low-thermal-conductivity portion 56 overlap the heat generating layer 522 of the heat source 52 in respective portions thereof that are on the downstream side in the moving direction. Herein, the state where the high-thermal-conductivity portion 53 and the low-thermal-conductivity portion 56 overlap the heat generating layer 522 of the heat source 52 applies to a case where the high-thermal-conductivity portion 53 and the low-thermal-conductivity portion 56 are seen in the direction of stacking thereof on the heat source 52 (the top-bottom direction in FIG. 5A).

As described above, a portion of the high-thermal-conductivity portion 53 overlaps the heat generating layer 522 of the heat source 52. Therefore, for example, if the temperature of the heat source 52 rises in the non-sheet-passing areas at the two width-direction ends of the heat source 52, the heat generated by the heat generating layer 522 tends to be quickly conducted to the high-thermal-conductivity portion 53. Hence, the temperature nonuniformity in the heat source 52 and in the fixing belt 51 tends to be slighter than in a case where the high-thermal-conductivity portion 53 does not overlap the heat generating layer 522.

As illustrated in FIGS. 4 and 5A, the temperature sensors 57 according to the first exemplary embodiment are provided at respective positions shifted from the high-thermal-conductivity portion 53 and the low-thermal-conductivity portion 56 in the moving direction. More specifically, the temperature sensors 57 are each provided in contact with the opposite surface 52B of the heat source 52 and at a position shifted from the high-thermal-conductivity portion 53 and the low-thermal-conductivity portion 56 toward the downstream side in the moving direction. In the following description, a portion of the temperature sensor 57 that is in contact with the opposite surface 52B of the heat source 52 is occasionally referred to as "contact portion."

As illustrated in FIGS. 4 and 5A, part of the contact portion of each of the temperature sensors 57 that is in contact with the opposite surface 52B of the heat source 52 overlaps the heat generating layer 522 of the heat source 52. Furthermore, as described above, the length (H2) of the heat generating layer 522 in the moving direction of the fixing belt 51 is smaller than the length of the nip part N in the moving direction of the fixing belt 51, and the heat generating layer 522 is positioned within the area corresponding to the nip part N. That is, the part of the contact portion of the temperature sensor 57 that is in contact with the opposite surface 52B of the heat source 52 and overlaps the heat generating layer 522 is positioned within the area corresponding to the nip part N.

In the fixing device 40 according to the first exemplary embodiment, since each of the temperature sensors 57 is provided at a position shifted from the high-thermal-conductivity portion 53 and the low-thermal-conductivity portion 56 in the moving direction, the temperature sensor 57 directly faces the heat source 52, avoiding the high-thermal-conductivity portion 53 and the low-thermal-conductivity portion 56. Hence, if there is any temperature change in the heat source 52, the heat conduction to the temperature sensor 57 is not prevented by the low-thermal-conductivity portion 56. Accordingly, the responsiveness of the temperature sensor 57 at any temperature change in the heat source 52 is less deteriorated than in a case where, for example, the temperature sensor 57 is provided on the high-thermal-conductivity portion 53.

Moreover, since part of the contact portion of the temperature sensor 57 that is in contact with the opposite surface 52B overlaps the heat generating layer 522 of the heat source 52, the temperature sensor 57 detects the heat of a portion of the heat source 52 that is heated by the heat generating layer 522. Hence, the temperature sensor 57 more assuredly detects abnormal heat generation or the like that may occur in the heat generating layer 522 of the heat source 52 than in a case where, for example, the temperature sensor 57 does not overlap the heat generating layer 522.

In the first exemplary embodiment, as described above, the temperature sensor 57 is provided on the downstream side with respect to the high-thermal-conductivity portion 53 and the low-thermal-conductivity portion 56 in the moving direction. The reason for such an arrangement will now be described.

Figure 6:
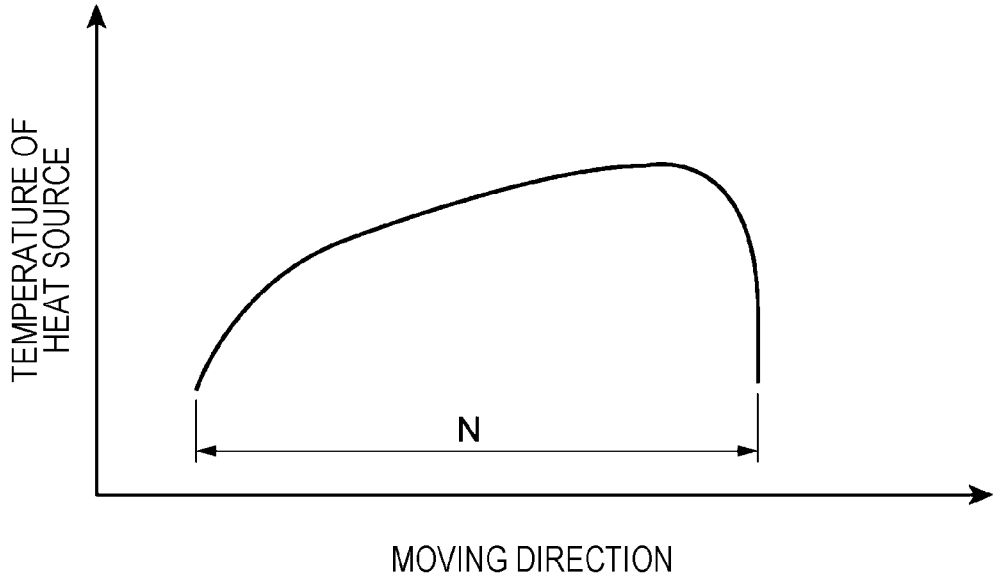
FIG. 6 is a graph illustrating an exemplary relationship between the position in a nip part of the fixing device in a moving direction and the temperature of the heat source.

FIG. 6 is a graph illustrating an exemplary relationship between the position in the nip part N of the fixing device 40 in the moving direction and the temperature of the heat source 52. As illustrated in FIG. 6, in the nip part N, while the fixing belt 51 is rotating, the temperature of the heat source 52 tends to increase from the upstream side toward the downstream side in the moving direction of the fixing belt 51.

In the first exemplary embodiment, since the temperature sensor 57 is provided on the downstream side with respect to the high-thermal-conductivity portion 53 and the low-thermal-conductivity portion 56 in the moving direction as described above, the temperature sensor 57 detects the temperature of the downstream portion of the heat source 52 in the moving direction where the temperature tends to be high. Hence, the temperature sensor 57 tends to more quickly detect abnormal heat generation or the like that may occur in the heat generating layer 522 of the heat source 52. In other words, the responsiveness of the temperature sensor 57 at a rise of the temperature of the heat source 52 is higher than in a case where the temperature sensor 57 is provided on the upstream side with respect to the high-thermal-conductivity portion 53 and the low-thermal-conductivity portion 56 in the moving direction.

The arrangement of the high-thermal-conductivity portion 53, the low-thermal-conductivity portion 56, and the temperature sensors 57 is not limited to the above, as long as the position of each of the temperature sensors 57 is shifted from the high-thermal-conductivity portion 53 and the low-thermal-conductivity portion 56 in the moving direction. For example, from the viewpoint of heat conduction from the high-temperature portion of the heat source 52 to the low-temperature portion of the heat source 52 through the high-thermal-conductivity portion 53, the high-thermal-conductivity portion 53 and the low-thermal-conductivity portion 56 may be provided on the downstream side in the moving direction on which the temperature of the heat source 52 tends to be high, and the temperature sensor 57 may be provided on the upstream side with respect to the high-thermal-conductivity portion 53 and the low-thermal-conductivity portion 56 in the moving direction.

In the case illustrated in FIG. 5A, the portions of the high-thermal-conductivity portion 53 and the low-thermal-conductivity portion 56 that are on the downstream side in the moving direction overlap the heat generating layer 522 of the heat source 52. The present disclosure is not limited to such an arrangement. For example, depending on the shape of the heat generating layer 522 of the heat source 52 and the shapes or other relevant factors of the high-thermal-conductivity portion 53 and the low-thermal-conductivity portion 56, the high-thermal-conductivity portion 53 and the low-thermal-conductivity portion 56 do not necessarily need to overlap the heat generating layer 522, as illustrated in FIG. 5B.

Second Exemplary Embodiment

A second exemplary embodiment of the present disclosure will now be described. Elements that are the same as those described in the first exemplary embodiment are denoted by corresponding ones of the reference numerals, and detailed description of those elements is omitted herein.

Figure 7:
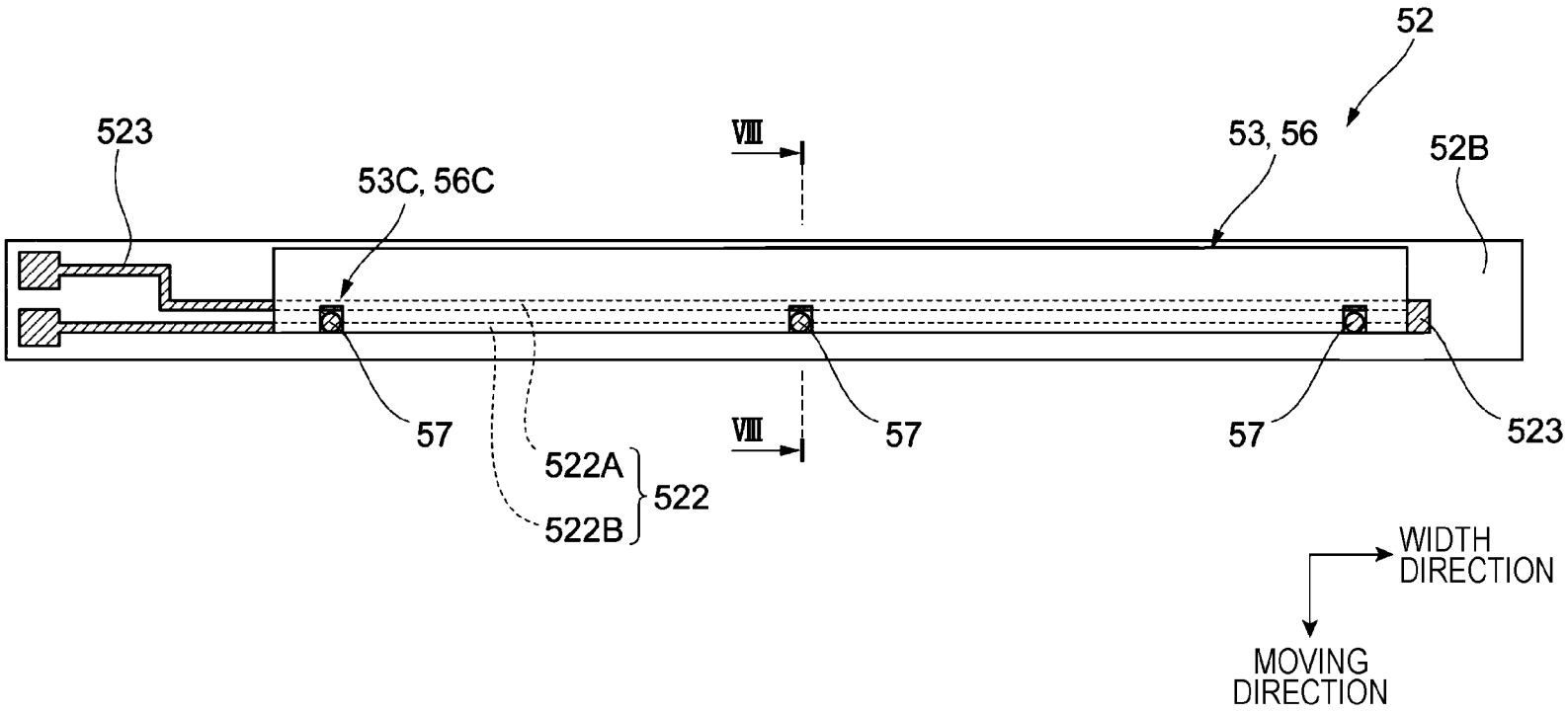
FIG. 7 illustrates an arrangement of a heat source, a high-thermal-conductivity portion, a low-thermal-conductivity portion, and temperature sensors according to a second exemplary embodiment.
Figure 8:
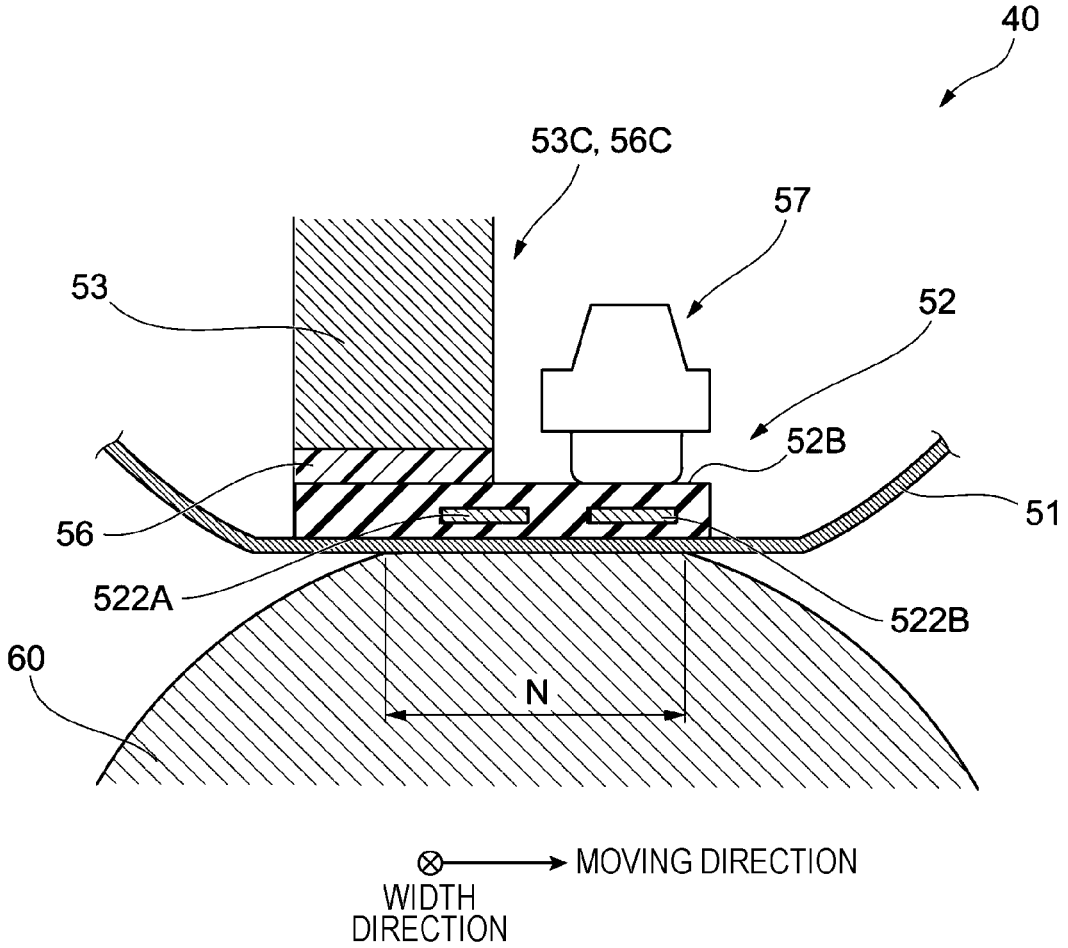
FIG. 8 illustrates the arrangement of the heat source, the high-thermal-conductivity portion, the low-thermal-conductivity portion, and the temperature sensors according to the second exemplary embodiment.

FIGS. 7 and 8 illustrate an arrangement of the heat source 52, the high-thermal-conductivity portion 53, the low-thermal-conductivity portion 56, and the temperature sensors 57 according to the second exemplary embodiment. FIG. 7 is a plan view of the heat source 52, the high-thermal-conductivity portion 53, the low-thermal-conductivity portion 56, and the temperature sensors 57 seen in the direction of stacking of the high-thermal-conductivity portion 53 and so forth on the heat source 52. FIG. 8 is a sectional view of a width-direction central portion of the fixing device 40, taken along line VIII-VIII illustrated in FIG. 7.

In FIG. 7, the base layer 521 of the heat source 52 is not illustrated. In the second exemplary embodiment, as with the case of the first exemplary embodiment, the high-thermal-conductivity portion 53 and the low-thermal-conductivity portion 56 have the same shape when seen in the direction of stacking thereof on the heat source 52. Therefore, in FIG. 7, the low-thermal-conductivity portion 56 is behind the high-thermal-conductivity portion 53 and is not illustrated. In FIG. 8, the power feeding layers 523 (see FIG. 7) of the heat source 52 are not illustrated, and the plurality of high-thermal-conductivity members 531 (see FIG. 2) are collectively illustrated as the high-thermal-conductivity portion 53.

The second exemplary embodiment differs from the first exemplary embodiment in the shape of the heat generating layer 522 of the heat source 52 and the shapes and other relevant factors of the high-thermal-conductivity portion 53 and the low-thermal-conductivity portion 56.

As illustrated in FIG. 7, the heat source 52 according to the second exemplary embodiment includes a plurality of (two in the second exemplary embodiment) heat generating layers 522 arranged side by side at intervals in the moving direction of the fixing belt 51 and each extending in the width direction of the fixing belt 51. Specifically, the heat generating layers 522 according to the second exemplary embodiment include an upstream heat generating layer 522A positioned on the upstream side of the heat source 52 in the moving direction and extending in the width direction, and a downstream heat generating layer 522B positioned on the downstream side and at an interval with respect to the upstream heat generating layer 522A in the moving direction and extending in the width direction. The upstream heat generating layer 522A and the downstream heat generating layer 522B are connected to each other in series at respective ends thereof on one width-direction side with the power feeding layer 523 interposed therebetween.

The upstream heat generating layer 522A and the downstream heat generating layer 522B have the same shape and each have a uniform length in the moving direction of the fixing belt 51 over the entirety thereof from one width-direction end to the other width-direction end.

The high-thermal-conductivity portion 53 and the low-thermal-conductivity portion 56 according to the second exemplary embodiment each generally have a long shape in the width direction. As illustrated in FIG. 7, the high-thermal-conductivity portion 53 and the low-thermal-conductivity portion 56 according to the second exemplary embodiment each have three rectangular cuts 53C (56C) provided at intervals in the width direction at the downstream end thereof in the moving direction in such a manner as to be recessed toward the upstream side in the moving direction.

In the second exemplary embodiment, the temperature sensors 57 are provided at respective positions of the opposite surface 52B of the heat source 52 that are exposed in the respective cuts 53C (56C) of the high-thermal-conductivity portion 53 and the low-thermal-conductivity portion 56.

According to the second exemplary embodiment illustrated in FIG. 8, at the width-direction positions of the fixing device 40 where the temperature sensors 57 are provided respectively, the temperature sensors 57 are shifted from the high-thermal-conductivity portion 53 and the low-thermal-conductivity portion 56 in the moving direction. That is, as with the case of the first exemplary embodiment, the temperature sensors 57 according to the second exemplary embodiment are provided in contact with the opposite surface 52B of the heat source 52 at respective positions that are shifted from the high-thermal-conductivity portion 53 and the low-thermal-conductivity portion 56 toward the downstream side in the moving direction.

Furthermore, in the second exemplary embodiment, part of the contact portion of each of the temperature sensors 57 that is in contact with the opposite surface 52B overlaps the downstream heat generating layer 522B, which is one of the two heat generating layers 522 that is on the downstream side in the moving direction.

As described above, in the second exemplary embodiment, the temperature sensors 57 are each provided at a position shifted from the high-thermal-conductivity portion 53 and the low-thermal-conductivity portion 56 in the moving direction, as with the case of the first exemplary embodiment. Hence, the responsiveness of the temperature sensor 57 at any temperature change in the heat source 52 is less deteriorated than in the case where, for example, the temperature sensor 57 is provided on the high-thermal-conductivity portion 53.

Moreover, since part of the contact portion of the temperature sensor 57 that is in contact with the opposite surface 52B overlaps the downstream heat generating layer 522B of the heat source 52, the temperature sensor 57 more assuredly detects abnormal heat generation or the like that may occur in the downstream heat generating layer 522B of the heat source 52 than in the case where, for example, the temperature sensor 57 does not overlap the heat generating layer 522.

As illustrated in FIGS. 7 and 8, at each of the width-direction positions where the cuts 53C (56C) and the respective temperature sensors 57 are provided, the high-thermal-conductivity portion 53 overlaps the upstream heat generating layer 522A of the heat source 52 with the low-thermal-conductivity portion 56 interposed therebetween. Furthermore, as illustrated in FIG. 7, in a width-direction area where no cuts 53C (56C) are provided, the high-thermal-conductivity portion 53 overlaps both the upstream heat generating layer 522A and the downstream heat generating layer 522B of the heat source 52 with the low-thermal-conductivity portion 56 interposed therebetween.

As described above, in the second exemplary embodiment as well, part of the high-thermal-conductivity portion 53 overlaps the heat generating layer 522 of the heat source 52. Therefore, for example, if the temperature of the heat source 52 rises in the non-sheet-passing areas at the two width-direction ends of the heat source 52, the heat generated by the heat generating layer 522 tends to be quickly conducted to the high-thermal-conductivity portion 53. Hence, the temperature nonuniformity in the heat source 52 and in the fixing belt 51 tends to be slighter than in the case where the high-thermal-conductivity portion 53 does not overlap the heat generating layer 522.

Third Exemplary Embodiment

A third exemplary embodiment of the present disclosure will now be described. Elements that are the same as those described in the first exemplary embodiment are denoted by corresponding ones of the reference numerals, and detailed description of those elements is omitted herein.

Figure 9:
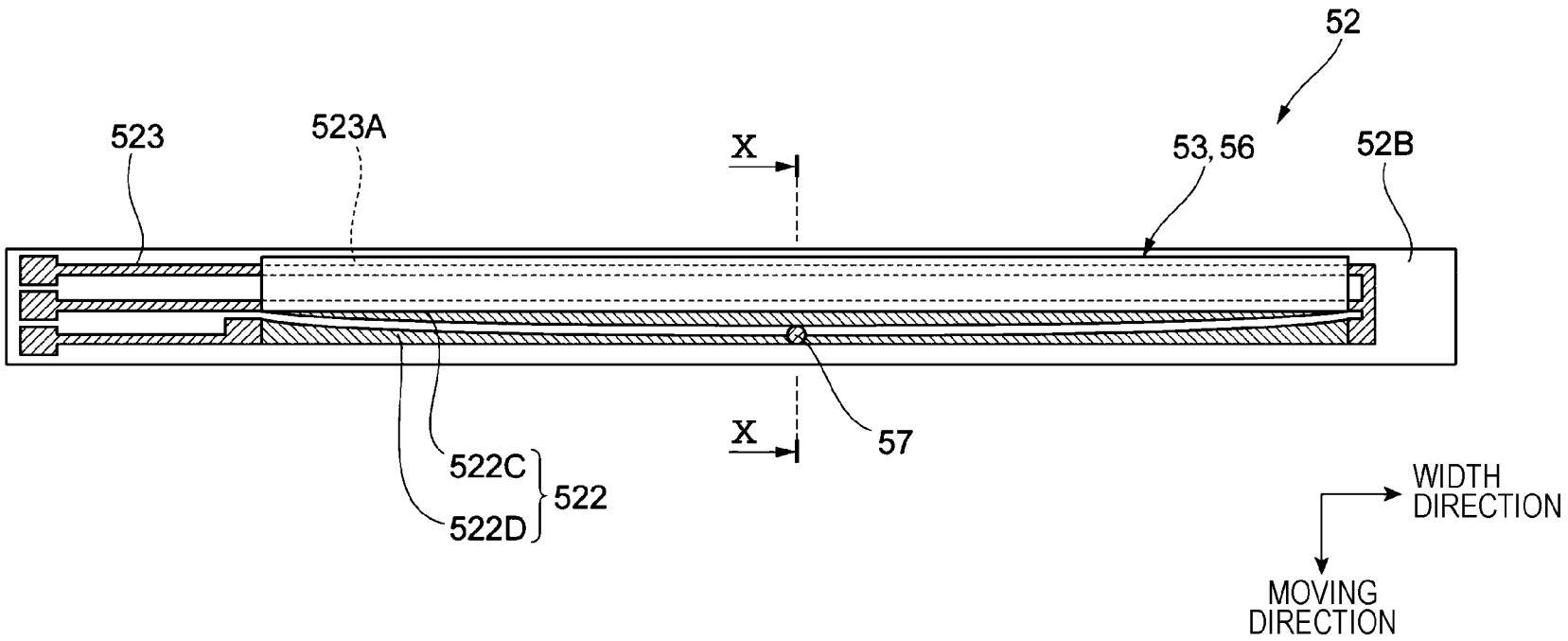
FIG. 9 illustrates an arrangement of a heat source, a high-thermal-conductivity portion, a low-thermal-conductivity portion, and temperature sensors according to a third exemplary embodiment.
Figure 10:
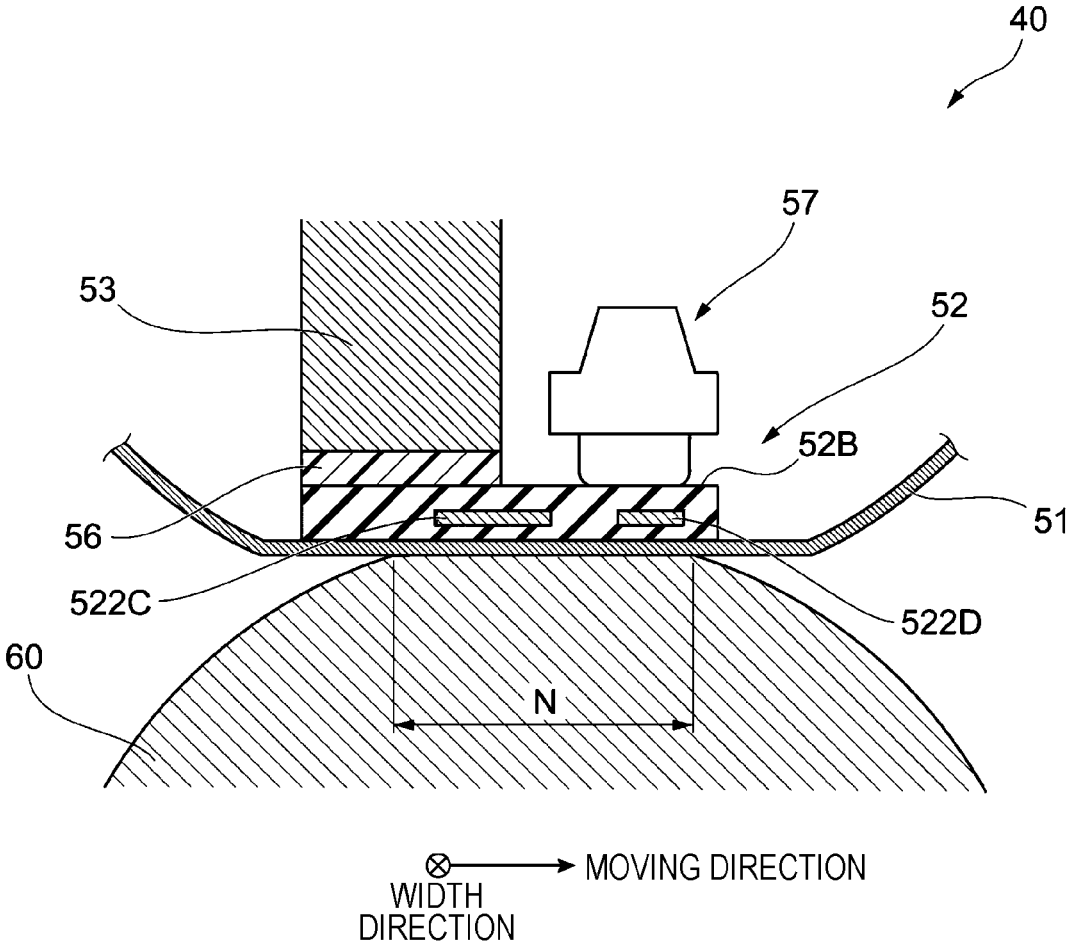
FIG. 10 illustrates the arrangement of the heat source, the high-thermal-conductivity portion, the low-thermal-conductivity portion, and the temperature sensors according to the third exemplary embodiment.

FIGS. 9 and 10 illustrate an arrangement of the heat source 52, the high-thermal-conductivity portion 53, the low-thermal-conductivity portion 56, and the temperature sensors 57 according to the third exemplary embodiment. FIG. 9 is a plan view of the heat source 52, the high-thermal-conductivity portion 53, the low-thermal-conductivity portion 56, and the temperature sensors 57 seen in the direction of stacking of the high-thermal-conductivity portion 53 and so forth on the heat source 52. FIG. 10 is a sectional view of a width-direction central portion of the fixing device 40, taken along line X-X illustrated in FIG. 9.

In FIG. 9, the base layer 521 of the heat source 52 is not illustrated. In the third exemplary embodiment, as with the case of the first exemplary embodiment, the high-thermal-conductivity portion 53 and the low-thermal-conductivity portion 56 have the same shape when seen in the direction of stacking thereof on the heat source 52. Therefore, in FIG. 9, the low-thermal-conductivity portion 56 is behind the high-thermal-conductivity portion 53 and is not illustrated. In FIG. 10, the power feeding layers 523 (see FIG. 9) of the heat source 52 are not illustrated, and the plurality of high-thermal-conductivity members 531 (see FIG. 2) are collectively illustrated as the high-thermal-conductivity portion 53.

The third exemplary embodiment differs from the first exemplary embodiment in the shape and other relevant factors of the heat generating layer 522 of the heat source 52.

As illustrated in FIG. 9, the heat source 52 according to the third exemplary embodiment includes a plurality of (two in the third exemplary embodiment) heat generating layers 522 arranged side by side at intervals in the moving direction of the fixing belt 51 and each extending in the width direction of the fixing belt 51. Specifically, the heat generating layers 522 according to the third exemplary embodiment include an upstream heat generating layer 522C positioned on the upstream side of the heat source 52 in the moving direction and extending in the width direction, and a downstream heat generating layer 522D positioned on the downstream side and at an interval with respect to the upstream heat generating layer 522C in the moving direction and extending in the width direction. The upstream heat generating layer 522C and the downstream heat generating layer 522D are each connected at one width-direction end thereof to the extended portion 523A of one of the power feeding layers 523.

The length of the upstream heat generating layer 522C, included in the heat generating layers 522, in the moving direction of the fixing belt 51 is smaller at the two width-direction ends thereof than in the width-direction central portion thereof. Accordingly, the amount of heat generated by the upstream heat generating layer 522C is greater at the two width-direction ends thereof than in the width-direction central portion thereof.

The length of the downstream heat generating layer 522D, included in the heat generating layers 522, in the moving direction of the fixing belt 51 is greater at the two width-direction ends thereof than in the width-direction central portion thereof. Accordingly, the amount of heat generated by the downstream heat generating layer 522D is smaller at the two width-direction ends thereof than in the width-direction central portion thereof.

As with the case of the first exemplary embodiment, the high-thermal-conductivity portion 53 and the low-thermal-conductivity portion 56 according to the third exemplary embodiment each generally have a long shape in the width direction, and each have a uniform length in the moving direction over the entirety thereof from one width-direction end to the other width-direction end.

The high-thermal-conductivity portion 53 and the low-thermal-conductivity portion 56 overlap the upstream heat generating layer 522C of the heat source 52. More specifically, the high-thermal-conductivity portion 53 and the low-thermal-conductivity portion 56 overlap the upstream heat generating layer 522C whose amount of heat generation at each of two width-direction ends is the greater between the two heat generating layers 522 included in the heat source 52.

As described above, if the sheet P to be subjected to the fixing process has a small width, the temperature of the heat source 52 tends to rise at the two width-direction ends. In the third exemplary embodiment, the high-thermal-conductivity portion 53 overlaps the upstream heat generating layer 522C whose amount of heat generation at each of the two width-direction ends is the greater. Therefore, the rise of the temperature at the two width-direction ends of each of the heat source 52 and the fixing belt 51 is suppressed more assuredly.

As illustrated in FIG. 10, the temperature sensor 57 according to the third exemplary embodiment is provided at a position shifted from the high-thermal-conductivity portion 53 and the low-thermal-conductivity portion 56 in the moving direction. That is, as with the case of the first exemplary embodiment, the temperature sensor 57 according to the third exemplary embodiment is provided in contact with the opposite surface 52B of the heat source 52 at a position shifted from the high-thermal-conductivity portion 53 and the low-thermal-conductivity portion 56 toward the downstream side in the moving direction.

Furthermore, in the third exemplary embodiment, part of the contact portion of each temperature sensor 57 that is in contact with the opposite surface 52B overlaps the downstream heat generating layer 522D, which is one of the two heat generating layers 522 that is on the downstream side in the moving direction.

As described above, in the third exemplary embodiment, the temperature sensors 57 are each provided at a position shifted from the high-thermal-conductivity portion 53 and the low-thermal-conductivity portion 56 in the moving direction, as with the case of the first exemplary embodiment. Hence, the responsiveness of the temperature sensor 57 at any temperature change in the heat source 52 is less deteriorated than in the case where, for example, the temperature sensor 57 is provided on the high-thermal-conductivity portion 53.

Moreover, since part of the contact portion of the temperature sensor 57 that is in contact with the opposite surface 52B overlaps the downstream heat generating layer 522D of the heat source 52, the temperature sensor 57 more assuredly detects abnormal heat generation or the like that may occur in the downstream heat generating layer 522D of the heat source 52 than in the case where, for example, the temperature sensor 57 does not overlap the heat generating layer 522.

Fourth Exemplary Embodiment

A fourth exemplary embodiment of the present disclosure will now be described. Elements that are the same as those described in the first exemplary embodiment are denoted by corresponding ones of the reference numerals, and detailed description of those elements is omitted herein.

Figure 11A:
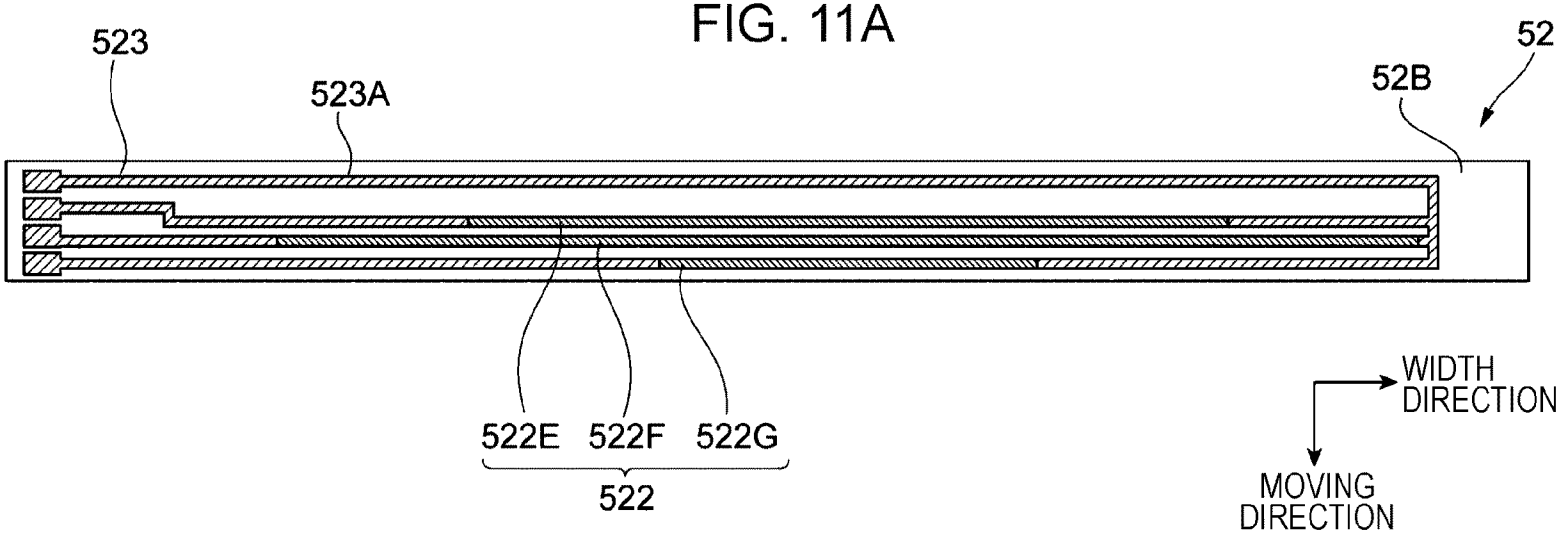
FIGS. 11A and 11B illustrate an arrangement of a heat source, a high-thermal-conductivity portion, a low-thermal-conductivity portion, and temperature sensors according to a fourth exemplary embodiment.
Figure 11B:
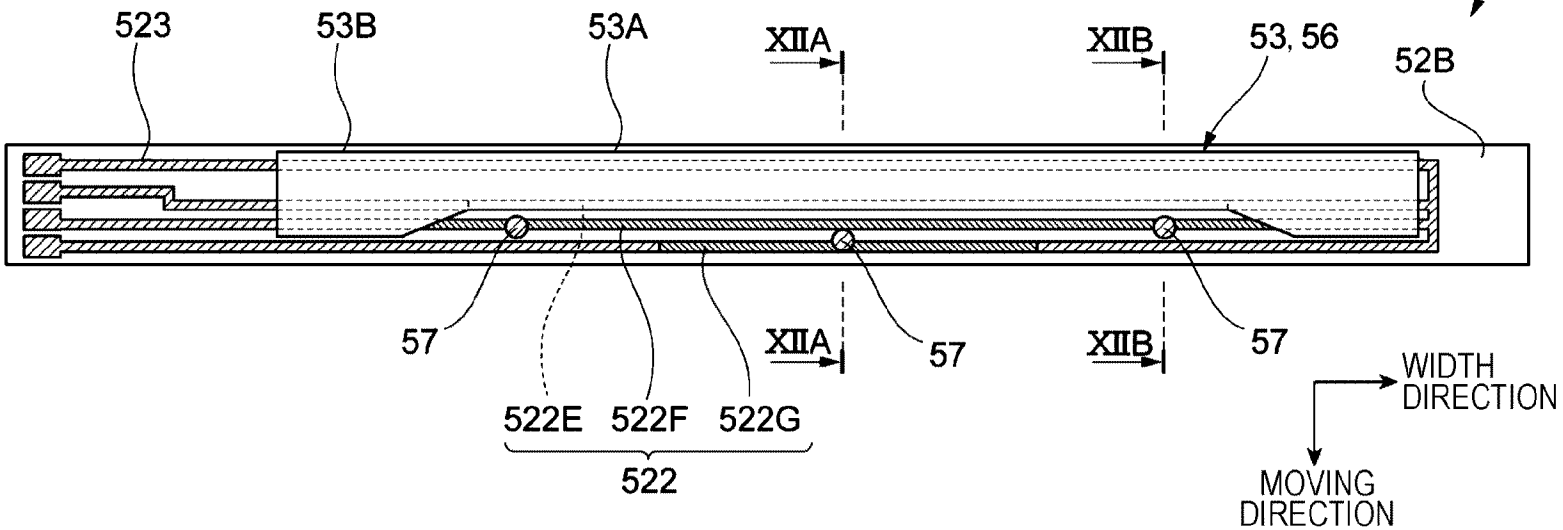
Figure 12A:
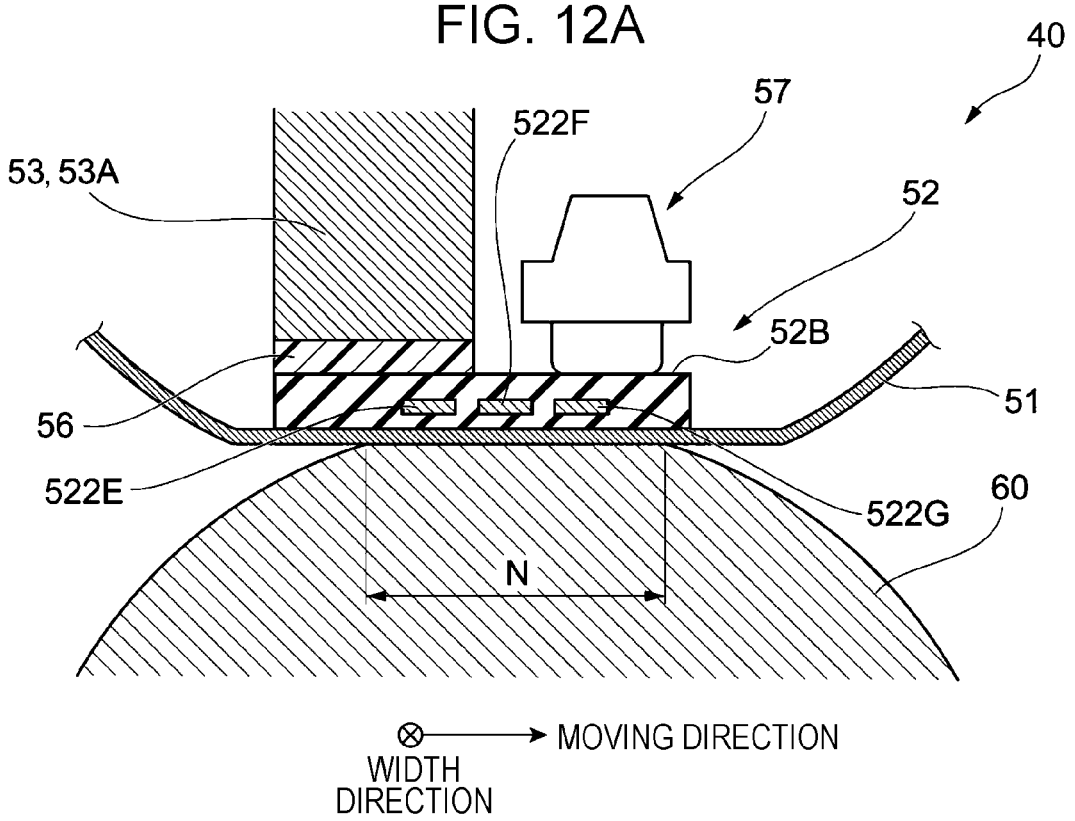
FIGS. 12A and 12B illustrate the arrangement of the heat source, the high-thermal-conductivity portion, the low-thermal-conductivity portion, and the temperature sensors according to the fourth exemplary embodiment.
Figure 12B:
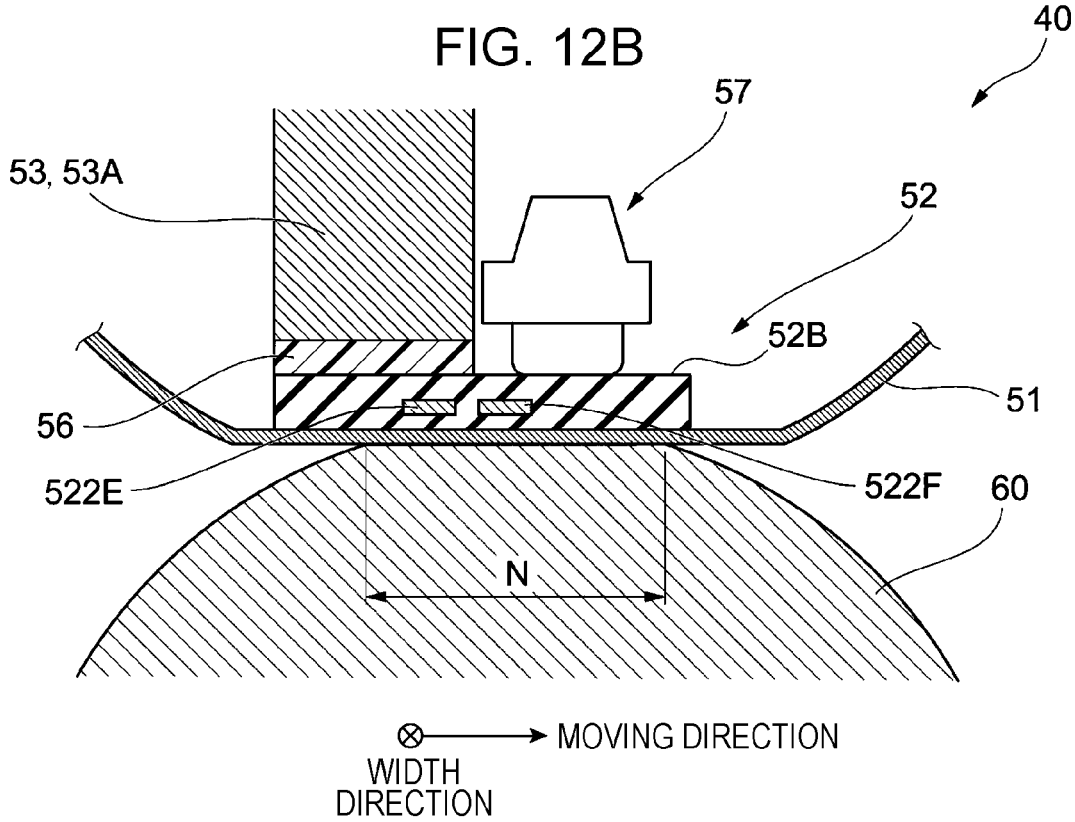

FIGS. 11A and 11B and FIGS. 12A and 12B illustrate an arrangement of the heat source 52, the high-thermal-conductivity portion 53, the low-thermal-conductivity portion 56, and the temperature sensors 57 according to the fourth exemplary embodiment. FIG. 11A is a plan view of the heat source 52. FIG. 11B is a plan view of the heat source 52, the high-thermal-conductivity portion 53, the low-thermal-conductivity portion 56, and the temperature sensors 57 seen in the direction of stacking of the high-thermal-conductivity portion 53 and so forth on the heat source 52. FIGS. 12A and 12B are sectional views of the fixing device 40, taken along line XIIA-XIIA and line XIIB-XIIB, respectively, illustrated in FIG. 11B.

In FIGS. 11A and 11B, the base layer 521 of the heat source 52 is not illustrated. In the fourth exemplary embodiment, as with the case of the first exemplary embodiment, the high-thermal-conductivity portion 53 and the low-thermal-conductivity portion 56 have the same shape when seen in the direction of stacking thereof on the heat source 52. Therefore, in FIG. 11B, the low-thermal-conductivity portion 56 is behind the high-thermal-conductivity portion 53 and is not illustrated. In FIGS. 12A and 12B, the power feeding layers 523 (see FIG. 11B) of the heat source 52 are not illustrated, and the plurality of high-thermal-conductivity members 531 (see FIG. 2) are collectively illustrated as the high-thermal-conductivity portion 53.

The fourth exemplary embodiment differs from the first exemplary embodiment in the shape of the heat generating layer 522 of the heat source 52 and the shapes and other relevant factors of the high-thermal-conductivity portion 53 and the low-thermal-conductivity portion 56.

As illustrated in FIG. 11A, the heat source 52 according to the fourth exemplary embodiment includes a plurality of (three in the fourth exemplary embodiment) heat generating layers 522 arranged side by side at intervals in the moving direction of the fixing belt 51 and each extending in the width direction of the fixing belt 51. Specifically, the heat generating layers 522 according to the fourth exemplary embodiment include, in order from the upstream side toward the downstream side of the heat source 52 in the moving direction, a first heat generating layer 522E, a second heat generating layer 522F, and a third heat generating layer 522G each extending in the width direction. The first heat generating layer 522E, the second heat generating layer 522F, and the third heat generating layer 522G are each connected at one width-direction end thereof to the extended portion 523A of one of the power feeding layers 523.

The first heat generating layer 522E, the second heat generating layer 522F, and the third heat generating layer 522G included in the heat generating layers 522 have different lengths in the width direction. In the fourth exemplary embodiment, the second heat generating layer 522F is the longest and the third heat generating layer 522G is the shortest in the width direction. That is, in terms of the length in the width direction, the following relationship is established: the second heat generating layer 522F>the first heat generating layer 522E>the third heat generating layer 522G.

In the fourth exemplary embodiment, the width-direction length of the second heat generating layer 522F is equal to the width of the widest one of the sheets transportable to the fixing device 40 (the maximum sheet width). Furthermore, the width-direction length of the third heat generating layer 522G is equal to the width of the narrowest one of the sheets transportable to the fixing device 40 (the minimum sheet width).

The first heat generating layer 522E, the second heat generating layer 522F, and the third heat generating layer 522G each have a uniform length in the moving direction over the entirety thereof from one width-direction end to the other width-direction end.

Accordingly, in the fourth exemplary embodiment, the amount of heat generation at the two width-direction ends is the greatest in the second heat generating layer 522F, which is the longest in the width direction among the heat generating layers 522 including the first heat generating layer 522E, the second heat generating layer 522F, and the third heat generating layer 522G.

The high-thermal-conductivity portion 53 according to the fourth exemplary embodiment generally has a long shape in the width direction. As illustrated in FIG. 11B, the length of the high-thermal-conductivity portion 53 according to the fourth exemplary embodiment in the moving direction is smaller in the width-direction central portion thereof than at the two width-direction ends thereof. In other words, the high-thermal-conductivity portion 53 according to the fourth exemplary embodiment includes a narrow portion 53A positioned in the width-direction central portion thereof, and wide portions 53B positioned at two respective width-direction ends of the narrow portion 53A and being wider than the narrow portion 53A in the moving direction. In the fourth exemplary embodiment, the length of the narrow portion 53A in the moving direction gradually increases toward each of the wide portions 53B at the two respective width-direction ends of the narrow portion 53A.

Seen in the direction of stacking of the high-thermal-conductivity portion 53 and so forth on the heat source 52, the low-thermal-conductivity portion 56 (not illustrated) has the same shape as the high-thermal-conductivity portion 53.

In the fourth exemplary embodiment, the narrow portion 53A of the high-thermal-conductivity portion 53 overlaps the first heat generating layer 522E of the heat source 52 with the low-thermal-conductivity portion 56 interposed therebetween. Furthermore, the wide portions 53B of the high-thermal-conductivity portion 53 each overlap the second heat generating layer 522F of the heat source 52 with the low-thermal-conductivity portion 56 interposed therebetween. More specifically, the high-thermal-conductivity portion 53 overlaps the second heat generating layer 522F whose amount of heat generation at the two width-direction ends is the greatest among the three heat generating layers 522 of the heat source 52, with the low-thermal-conductivity portion 56 interposed therebetween.

As described above, if the sheet P to be subjected to the fixing process has a small width, the temperature of the heat source 52 tends to rise at the two width-direction ends. In the fourth exemplary embodiment, the high-thermal-conductivity portion 53 overlaps the second heat generating layer 522F whose amount of heat generation at the two width-direction ends is the greatest. Therefore, the rise of the temperature at the two width-direction ends of each of the heat source 52 and the fixing belt 51 is suppressed more assuredly.

As illustrated in FIGS. 12A and 12B, the temperature sensor 57 according to the fourth exemplary embodiment is provided at a position shifted from the high-thermal-conductivity portion 53 and the low-thermal-conductivity portion 56 in the moving direction. More specifically, the temperature sensor 57 according to the fourth exemplary embodiment is provided in contact with the opposite surface 52B of the heat source 52 at a position shifted from the narrow portion 53A of the high-thermal-conductivity portion 53 toward the downstream side in the moving direction.

As described above, in the fourth exemplary embodiment, the temperature sensor 57 according to the fourth exemplary embodiment is provided at a position shifted from the high-thermal-conductivity portion 53 and the low-thermal-conductivity portion 56 in the moving direction, as with the case of the first exemplary embodiment. Hence, the responsiveness of the temperature sensor 57 at any temperature change in the heat source 52 is less deteriorated than in the case where, for example, the temperature sensor 57 is provided on the high-thermal-conductivity portion 53.

Furthermore, in the fourth exemplary embodiment, as illustrated in FIGS. 11B and 12A, one of the three temperature sensors 57 that is at the width-direction center overlaps the third heat generating layer 522G of the heat source 52 in part of the contact portion thereof that is in contact with the opposite surface 52B. More specifically, the temperature sensor 57 at the width-direction center overlaps the third heat generating layer 522G that is the shortest in the width direction among the three heat generating layers 522.

As described above, the width-direction length of the third heat generating layer 522G is equal to the minimum sheet width. Hence, any sheet P transported to the fixing device 40 passes through an area of the nip part N that corresponds to the third heat generating layer 522G with the fixing belt 51 interposed therebetween, regardless of the size of the sheet P. In the fourth exemplary embodiment, since part of the contact portion of the temperature sensor 57 overlaps the third heat generating layer 522G, the temperature sensor 57 is capable of detecting the temperature of a portion of the heat source 52 that corresponds to the area over which the sheet P passes.

In the fourth exemplary embodiment, as illustrated in FIGS. 11B and 12B, two of the three temperature sensors 57 that are at the two respective width-direction ends each overlap the second heat generating layer 522F of the heat source 52 in part of the contact portion thereof that is in contact with the opposite surface 52B. In other words, the temperature sensors 57 at the two width-direction ends each overlap one of the heat generating layers 522 that is different from the one that the temperature sensor 57 at the width-direction center overlaps.

Hence, any of the temperature sensors 57 more assuredly detect abnormal heat generation or the like that may occur in any of the plurality of heat generating layers 522 than in a case where, for example, the plurality of temperature sensors 57 all overlap the same one of the heat generating layers 522 of the heat source 52. In the fourth exemplary embodiment, abnormal heat generation or the like that may occur in the second heat generating layer 522F tends to be detected by the temperature sensors 57 at the two width-direction ends, and abnormal heat generation or the like that may occur in the third heat generating layer 522G tends to be detected by the temperature sensor 57 at the width-direction center.

In the fourth exemplary embodiment illustrated in FIG. 11B and FIGS. 12A and 12B, the contact portion of each of the temperature sensors 57 overlaps one of the plurality of heat generating layers 522 (the first heat generating layer 522E, the second heat generating layer 522F, and the third heat generating layer 522G) of the heat source 52. Alternatively, the contact portion of each of the temperature sensors 57 may overlap some of the plurality of heat generating layers 522.

While the first to fourth exemplary embodiments of the present disclosure have been described, the above exemplary embodiments may be combined in any way, as long as the object of the present disclosure is achieved.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

a contact portion that comes into contact with a recording material transported;

a heat source that heats the contact portion and has a counter surface and an opposite surface, the counter surface facing the contact portion;

a high-thermal-conductivity portion provided on the opposite surface of the heat source and extending in a width direction intersecting a transport direction of the recording material, the high-thermal-conductivity portion having a higher thermal conductivity than the contact portion;

a low-thermal-conductivity portion provided between the opposite surface of the heat source and the high-thermal-conductivity portion and having a lower thermal conductivity than the high-thermal-conductivity portion; and a temperature detector that detects a temperature of the heat source and is provided on the opposite surface of the heat source and at a position shifted from the high-thermal-conductivity portion and the low-thermal-conductivity portion in the transport direction, wherein the low-thermal-conductivity portion and the temperature detector are directly contact with the opposite surface of the heat source.

2. The fixing device according to claim 1, wherein the temperature detector is provided on a downstream side with respect to the high-thermal-conductivity portion and the low-thermal-conductivity portion in the transport direction.

3. The fixing device according to claim 1, wherein the temperature detector is provided on an upstream side with respect to the high-thermal-conductivity portion and the low-thermal-conductivity portion in the transport direction.

4. The fixing device according to claim 1, wherein the heat source includes a heat generator that generates heat and that extends in the width direction intersecting the transport direction, and wherein at least part of the temperature detector overlaps the heat generator.

5. The fixing device according to claim 4, further comprising:

a pressing portion that faces the heat generator of the heat source with the contact portion provided in between and defines a pressing area between the pressing portion and the contact portion through which the recording material passes, wherein the temperature detector overlaps the heat generator at a position corresponding to the pressing area.

6. The fixing device according to claim 5, wherein the heat generator of the heat source is one of a plurality of heat generators having different lengths in the width direction, and wherein the temperature detector overlaps one of the plurality of heat generators that is shortest in the width direction.

7. The fixing device according to claim 4, wherein the heat generator of the heat source is one of a plurality of heat generators, and wherein the temperature detector is one of a plurality of temperature detectors that overlap respective heat generators.

8. The fixing device according to claim 1, wherein the heat source includes a heat generator that generates heat and that extends in the width direction intersecting the transport direction, and wherein at least part of the high-thermal-conductivity portion overlaps the heat generator.

9. The fixing device according to claim 8, wherein the heat generator of the heat source is one of a plurality of heat generators that generate different amounts of heat each varying in the width direction, and wherein the high-thermal-conductivity portion overlaps one of the plurality of heat generators whose amount of heat generation at each of two ends in the width direction is greatest.

10. The fixing device according to claim 9, wherein the plurality of heat generators of the heat source have different lengths in the width direction, and wherein the high-thermal-conductivity portion overlaps one of the heat generators that is longest in the width direction.

11. An image forming apparatus comprising:

an image forming device that forms an image on a recording material; and a fixing device that fixes the image formed by the image forming device to the recording material, wherein the fixing device is the fixing device according to claim 1.

12. A fixing device comprising:

a contact portion that comes into contact with a recording material transported;

a heat source that heats the contact portion and has a counter surface and an opposite surface, the counter surface facing the contact portion;

a high-thermal-conductivity portion provided on the opposite surface of the heat source and extending in a width direction intersecting a transport direction of the recording material, the high-thermal-conductivity portion having a higher thermal conductivity than the contact portion;

a low e al-conductivity portion provided between the opposite surface of the heat source and the high-thermal-conductivity portion and having a lower thermal conductivity than the high-thermal-conductivity portion; and temperature detecting means that detects a temperature of the heat source and is provided on the opposite surface of the heat source and at a position shifted from the high-thermal-conductivity portion and the low-thermal-conductivity portion in the transport direction, wherein the low-thermal-conductivity portion and the temperature detecting means are directly contact with the opposite surface of the heat source.

* * * * *